US011223120B2

(12) United States Patent
Ueda et al.

(10) Patent No.: US 11,223,120 B2
(45) Date of Patent: Jan. 11, 2022

(54) ANTENNA MODULE AND ANTENNA DEVICE

(71) Applicant: Murata Manufacturing Co., Ltd., Kyoto (JP)

(72) Inventors: Hideki Ueda, Kyoto (JP); Tsubasa Nishida, Kyoto (JP); Shinya Mizoguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 18 days.

(21) Appl. No.: 16/749,316

(22) Filed: Jan. 22, 2020

(65) Prior Publication Data

US 2020/0243957 A1 Jul. 30, 2020

(30) Foreign Application Priority Data

Jan. 30, 2019 (JP) ..... JP2019-014629
Jun. 27, 2019 (JP) ..... JP2019-119672

(51) Int. Cl.
*H01Q 1/38* (2006.01)
*H01Q 1/00* (2006.01)
*H01Q 21/06* (2006.01)

(52) U.S. Cl.
CPC ..... *H01Q 1/38* (2013.01); *H01Q 1/002* (2013.01); *H01Q 21/065* (2013.01)

(58) Field of Classification Search
CPC ..... H01Q 21/065; H01Q 21/00; H01Q 1/38; H01Q 1/002; H01Q 21/205; H01Q 1/24; H01Q 9/04; H01Q 1/36
See application file for complete search history.

(56) References Cited

U.S. PATENT DOCUMENTS

2017/0309992 A1* 10/2017 Noori ..... H01Q 1/2258
2019/0207323 A1* 7/2019 Joung, Il ..... H01Q 1/526
2020/0112081 A1* 4/2020 Kim ..... H05K 1/148
2020/0144710 A1* 5/2020 Ndip ..... H01Q 5/392
2020/0381843 A1* 12/2020 Murata ..... H01Q 11/14
2020/0395675 A1* 12/2020 Han ..... H01Q 1/243
2020/0395681 A1* 12/2020 Ueda ..... H01Q 3/2611

FOREIGN PATENT DOCUMENTS

JP S61-208903 A 9/1986
JP H07-273534 A 10/1995
JP 2013-46291 A 3/2013
JP 5904465 B2 4/2016
WO 2018/088051 A1 5/2018

* cited by examiner

*Primary Examiner* — David E Lotter
(74) *Attorney, Agent, or Firm* — Pearne & Gordon LLP

(57) ABSTRACT

An antenna module includes a dielectric substrate, a plurality of patch antennas, an integrated circuit, a connector, a heat-radiating member, and connection members. The dielectric substrate includes a first substrate part, a second substrate part, and a third substrate part. The second substrate part is bent toward a rear surface of the first substrate part with respect to the front surface of the first substrate part and the third substrate part is bent toward the rear surface of the first substrate part with respect to the front surface of the first substrate part.

20 Claims, 36 Drawing Sheets

ANTENNA MODULE AND ANTENNA DEVICE

This application claims priority from Japanese Patent Application No. 2019-014629 filed on Jan. 30, 2019, and claims priority from Japanese Patent Application No. 2019-119672 filed on Jun. 27, 2019. The content of these applications are incorporated herein by reference in their entireties.

BACKGROUND OF THE DISCLOSURE

1. Field of the Disclosure

The present disclosure relates to an antenna module and an antenna device.

2. Description of the Related Art

It is required that antenna modules used for wireless communication appropriately transmit and receive data. Japanese Unexamined Patent Application Publication No. 2013-46291 discloses an antenna module in which the number of mounting pads provided on the lower surface of a dielectric substrate on which an antenna chip is mounted is increased while decreasing interference between antenna surface conductor layers in order to support an increase in the amount of data and perform transmission and reception of data.

It is also required that antenna coverage be secured across a range in which an antenna module is to transmit and receive data in order to realize appropriate transmission and reception of data. Coverage may be secured using a plurality of antenna modules. However, when a plurality of antenna modules are provided, there is a problem in that the area occupied by the antenna modules undesirably increases. In addition, an increase in the number of antenna modules leads to an increase in the size of a communication device.

BRIEF SUMMARY OF THE DISCLOSURE

The present disclosure was made in light of the above-described circumstances and it is an object thereof to secure coverage without increasing the number of antenna modules or incurring an increase in size.

An antenna module according to a preferred embodiment of the present disclosure includes: a dielectric substrate; a plurality of patch antennas arranged on a front surface of the dielectric substrate; an integrated circuit that controls transmission and reception of radio waves by the plurality of patch antennas; a connector that is used for inputting and outputting signals between the integrated circuit and the outside; a heat-radiating member that is provided so as to contact the integrated circuit (heat-radiating member that radiates heat generated by the integrated circuit); and a connection member that connects the dielectric substrate and the heat-radiating member to each other. The dielectric substrate at least includes: a first substrate part that has a front surface on which patch antennas of a first group, out of the plurality of patch antennas, are arranged and a rear surface on which the integrated circuit and the connector are arranged; a second substrate part that has a front surface on which patch antennas of a second group, out of the plurality of patch antennas, are arranged; and a third substrate part having a front surface on which patch antennas of a third group, out of the plurality of patch antennas, are arranged. The second substrate part is bent toward the rear surface of the first substrate part with respect to the front surface of the first substrate part and the third substrate part is bent toward the rear surface of the first substrate part with respect to the front surface of the first substrate part. The patch antennas of the first group, the patch antennas of the second group, and the patch antennas of the third group have different radiation directions from each other. The heat-radiating member is arranged so as to contact the integrated circuit on the rear surface side of the first substrate part.

According to the preferred embodiment of the present disclosure, coverage can be secured without increasing the number of antenna modules or incurring an increase in size.

Other features, elements, characteristics and advantages of the present disclosure will become more apparent from the following detailed description of preferred embodiments of the present disclosure with reference to the attached drawings.

DETAILED DESCRIPTION OF THE DISCLOSURE

Figure 1:
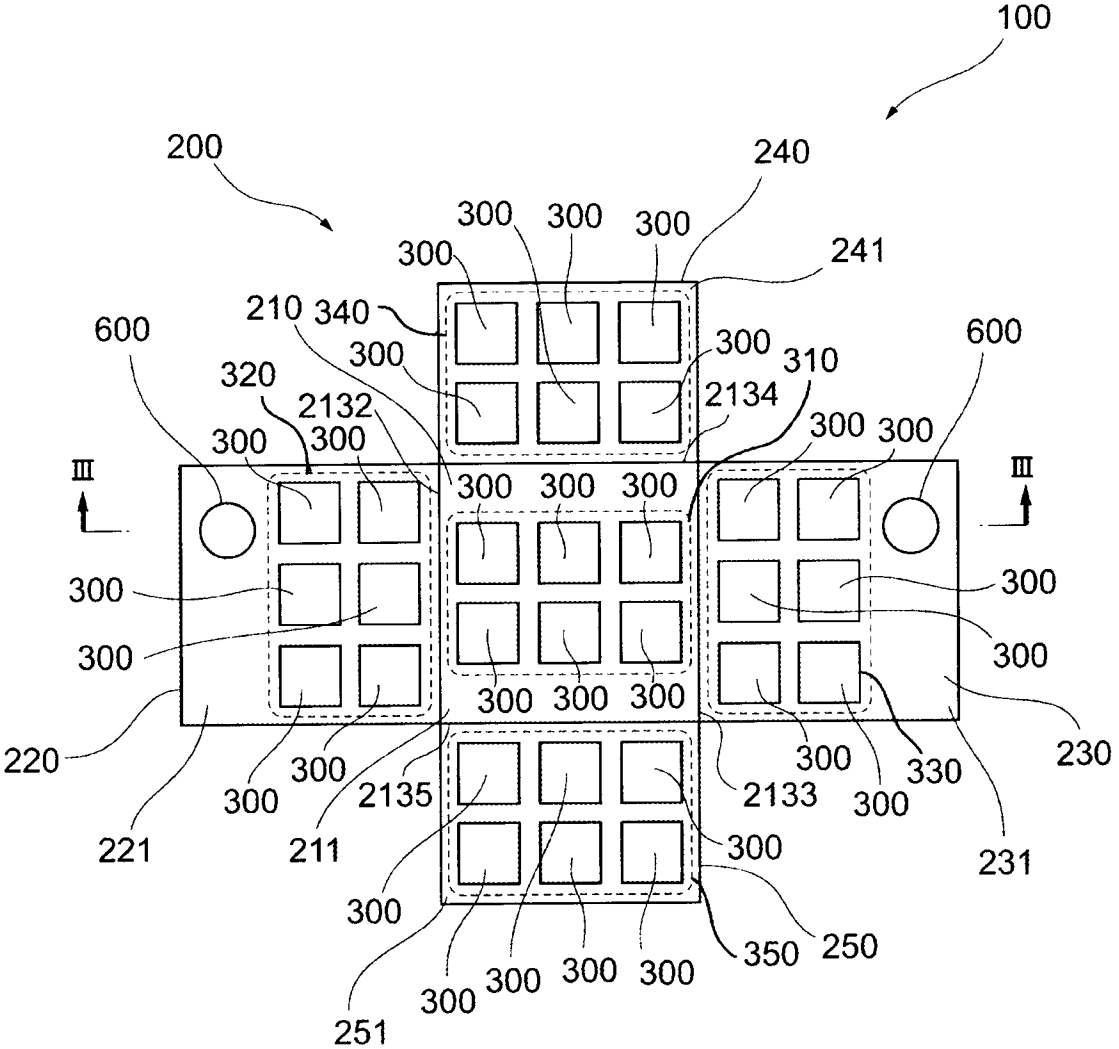
FIG. 1 is a plan view seen from a front surface side of an antenna module according to a first embodiment.

Hereafter, embodiments of the present disclosure will be described in detail while referring to the drawings. In addition, identical elements will be denoted by identical symbols and repeated description thereof will be omitted as much as possible.

An antenna module 100 according to a first embodiment will be described while referring to FIGS. 1 to 3A-3C. The antenna module 100 includes an integrated circuit 110, a dielectric substrate 200, a plurality of patch antennas 300, a connector 400, a heat-radiating member 500, and connection members 600. For example, the antenna module 100 transmits and receives radio waves in a millimeter wave band.

As illustrated in the plan view of FIG. 1, the dielectric substrate 200 includes substrate parts 210, 220, 230, 240, and 250.

For example, a low-temperature co-fired ceramic (LTCC) multilayer substrate may be used as the dielectric substrate. Alternatively, a multilayer substrate using a ceramic other than an LTCC may be used.

Furthermore, a multilayer resin substrate formed by stacking a plurality of resin layers composed of a resin such as epoxy resin or polyimide may be used. A multilayer resin substrate formed by stacking a plurality of resin layers composed of a liquid crystal polymer (LCP) having a low dielectric constant may be used. In addition, a multilayer resin substrate formed by stacking a plurality of resin layers composed of a fluorine-based resin may be used.

The substrate parts 210, 220, 230, 240, and 250 are each composed of a substantially rectangular substrate. An antenna group 310 consisting of a plurality of patch antennas 300 is arranged on a front surface 211 of the substrate part 210. The antenna group 310 corresponds to patch antennas of a first group in the Claims. The substrate part 210 corresponds to a first substrate part in the Claims.

The substrate part 220 has a front surface 221 on which an antenna group 320 composed of a plurality of patch antennas 300 is arranged on the front surface 211 side of the substrate part 210. The antenna group 320 corresponds to patch antennas of a second group or patch antennas of a third group in the Claims. The substrate part 220 corresponds to a second substrate part or a third substrate part in the Claims.

The substrate part 230 has a front surface 231 on which an antenna group 330 composed of a plurality of patch antennas 300 is arranged on the front surface 211 side of the substrate part 210. The antenna group 330 corresponds to patch antennas of a second group or patch antennas of a third group in the Claims. The substrate part 230 corresponds to a second substrate part or a third substrate part in the Claims.

Similarly to the substrate part 220, the substrate parts 240 and 250 respectively have front surfaces 241 and 251 on which antenna groups 340 and 350 composed of a plurality of patch antennas 300 are arranged on the front surface 211 side of the substrate part 210. The antenna group 340 corresponds to patch antennas of a second group or patch antennas of a third group in the Claims. The substrate part 240 corresponds to a second substrate part or a third substrate part in the Claims. The antenna group 350 corresponds to patch antennas of a second group or patch antennas of a third group in the Claims. The substrate part 250 corresponds to a second substrate part or a third substrate part in the Claims.

The connection members 600, which connect the dielectric substrate 200 and the heat-radiating member 500, which will be described later, to each other, are arranged in the substrate parts 220 and 230.

Figure 2:
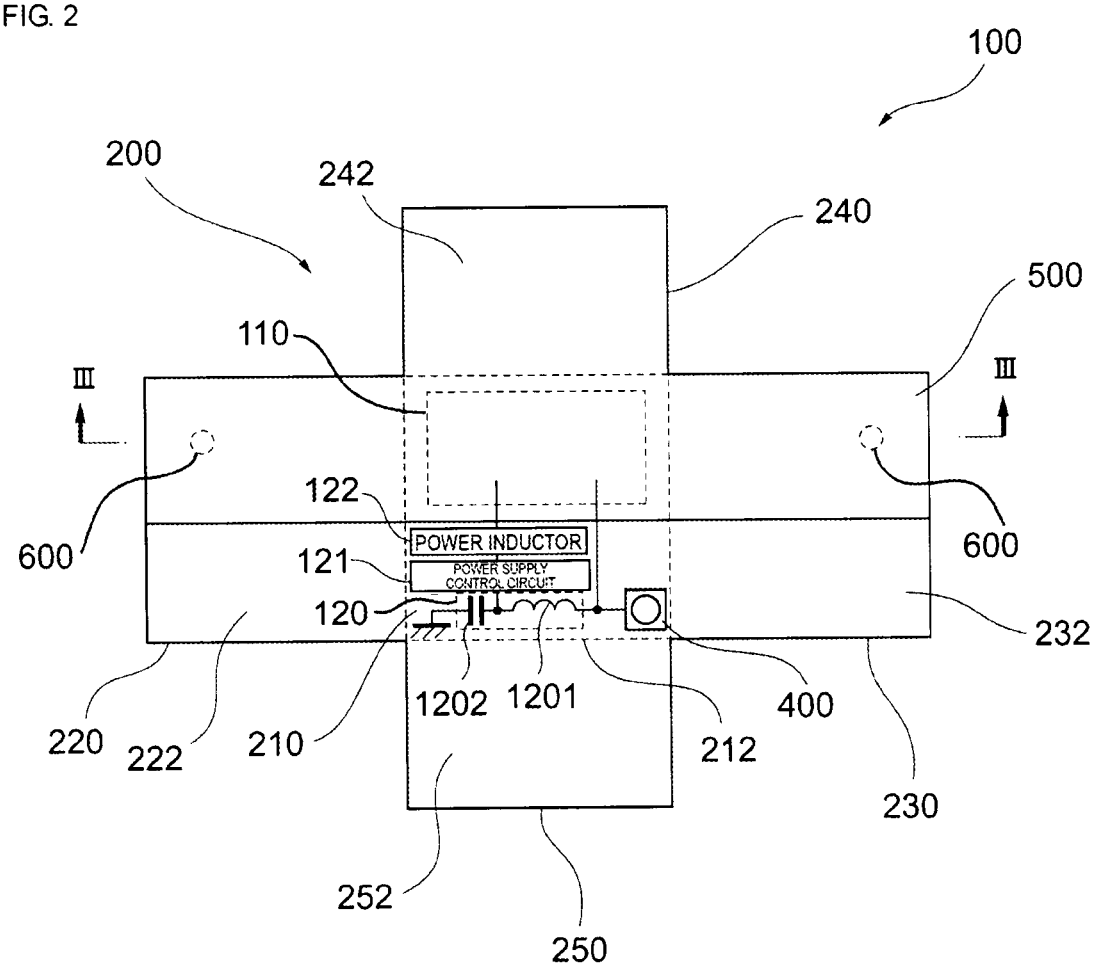
FIG. 2 is a plan view seen from a rear surface side of the antenna module according to the first embodiment.

FIG. 2 is a plan view in which the antenna module 100 in FIG. 1 is viewed from the rear surface side. As illustrated in FIG. 2, the integrated circuit 110, a bias tee circuit 120, a power supply control circuit 121, a power inductor 122, and the connector 400 are arranged on a rear surface 212 of the substrate part 210.

The integrated circuit 110 controls transmission and reception of radio waves by the antenna groups 310, 320, 330, 340, and 350. The integrated circuit 110 supplies power to the patch antennas 300. The connector 400 is provided to enable inputting and outputting of signals between the integrated circuit 110 and the outside.

The bias tee circuit 120 includes an inductor 1201 and a capacitor 1202. One end of the inductor 1201 is connected to the connector 400. The other end of the inductor 1201 is connected to one end of the capacitor 1202. The other end of the capacitor 1202 is connected to ground. The bias tee circuit 120 functions as a low pass filter for extracting a direct current component from a signal inputted to the connector 400.

The power supply control circuit 121 is connected to a connection point between the inductor 1201 and the capacitor 1202. One end of the power inductor 122 is connected to the power supply control circuit 121. The other end of the power inductor 122 is connected to the integrated circuit. Signals that are supplied to the connector 400 will be described later.

Furthermore, the heat-radiating member 500 is arranged on the rear surface 212 side of the substrate part 210 so as to contact the integrated circuit 110. The heat-radiating member 500 is provided in order to radiate the heat generated by the integrated circuit 110. So long as a function is realized that the heat generated by the integrated circuit 110 is radiated to the heat-radiating member 500, the heat-radiating member 500 may be arranged so as to indirectly contact the integrated circuit 110 or may be arranged so as to directly contact the integrated circuit 110. The heat-radiating member 500 is attached to the dielectric substrate 200 by the connection members 600. The heat-radiating member 500 is for example a casing in which the antenna module is provided or a heat sink. The connection members 600 are for example pins, screws, double-sided tape, or an adhesive. In the case where the connection members 600 consist of double-sided tape or an adhesive, the connection members 600 may be provided on the side of the integrated circuit 110 that is on the opposite side from the rear surface 212 (FIG. 3B) or may be provided on rear surfaces 222 and 232 sides of the substrate parts 220 and 230 (FIG. 3C). In the case where the connection members 600 consisting of double-side tape or an adhesive are provided on the side of the integrated circuit 110 that is on the opposite side from the rear surface 212, close contact is maintained between the integrated circuit 110 and the heat-radiating member 500 and therefore heat radiation performance is improved. In the case where the connection members 600 consisting of double-sided tape or an adhesive are provided on the rear surfaces 222 and 232 sides of the substrate parts 220 and 230, the connection members 600 contribute to maintaining the angles of the substrate parts and therefore radio wave radiation performance is improved. In addition, the connection members 600 consisting of double-sided tape or an adhesive may be provided both on the side of the integrated circuit 110 on the opposite side from the rear surface 212 and on the rear surfaces 222 and 232 sides of the substrate parts 220 and 230. Furthermore, the connection members 600 consisting of double-sided tape or an adhesive may be provided on the rear surface of the substrate part 240 or 250 or on the rear surfaces of both substrate parts (on rear surface 242 or 252 or both). The connection members 600 consisting of double-sided tape or an adhesive may be provided on the rear surface 212 side of the substrate part 210. In the case where the connection members 600 consist of pins or screws, the substrate parts and the heat-radiating member are firmly held together.

Figure 3A:
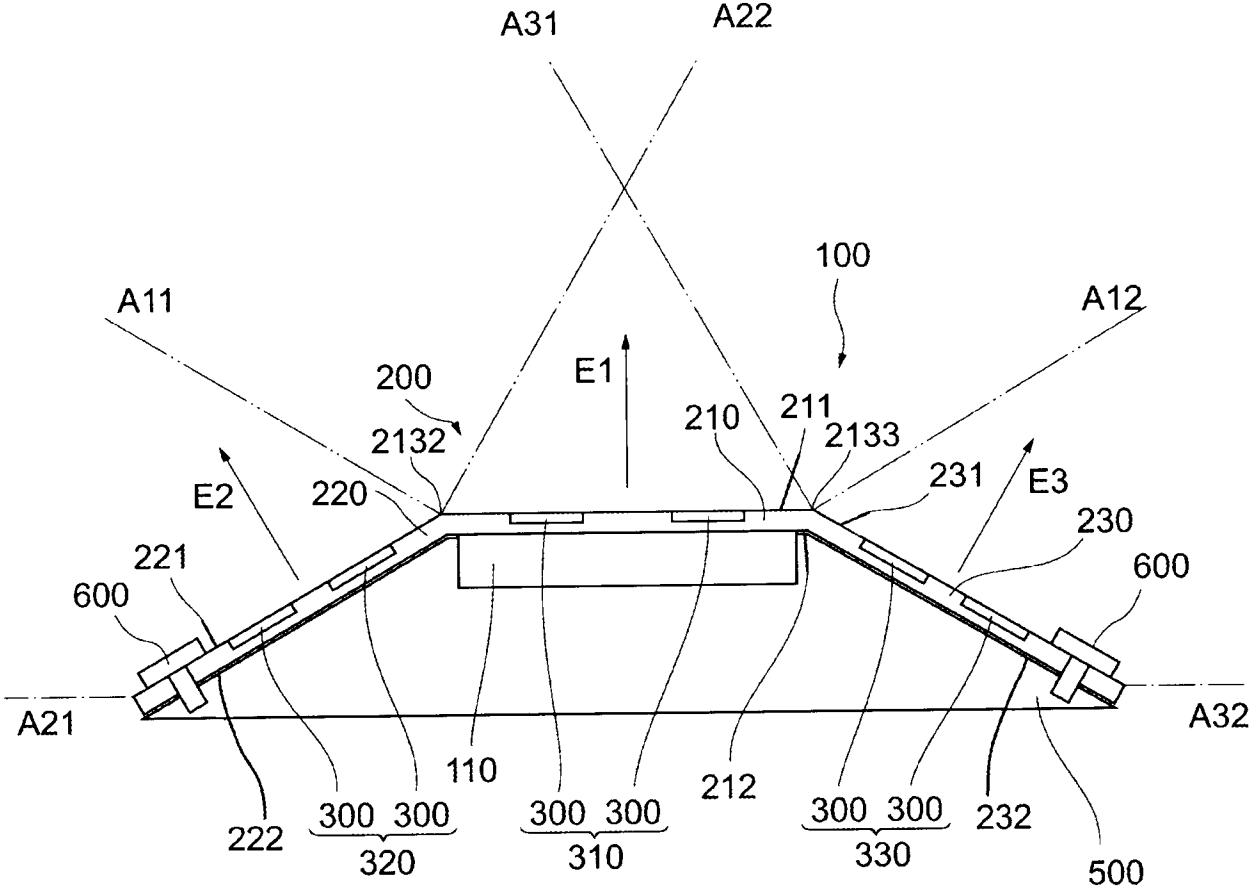
FIGS. 3A to 3C are sectional views of the antenna module according to the first embodiment taken in direction III-III.
Figure 3B:
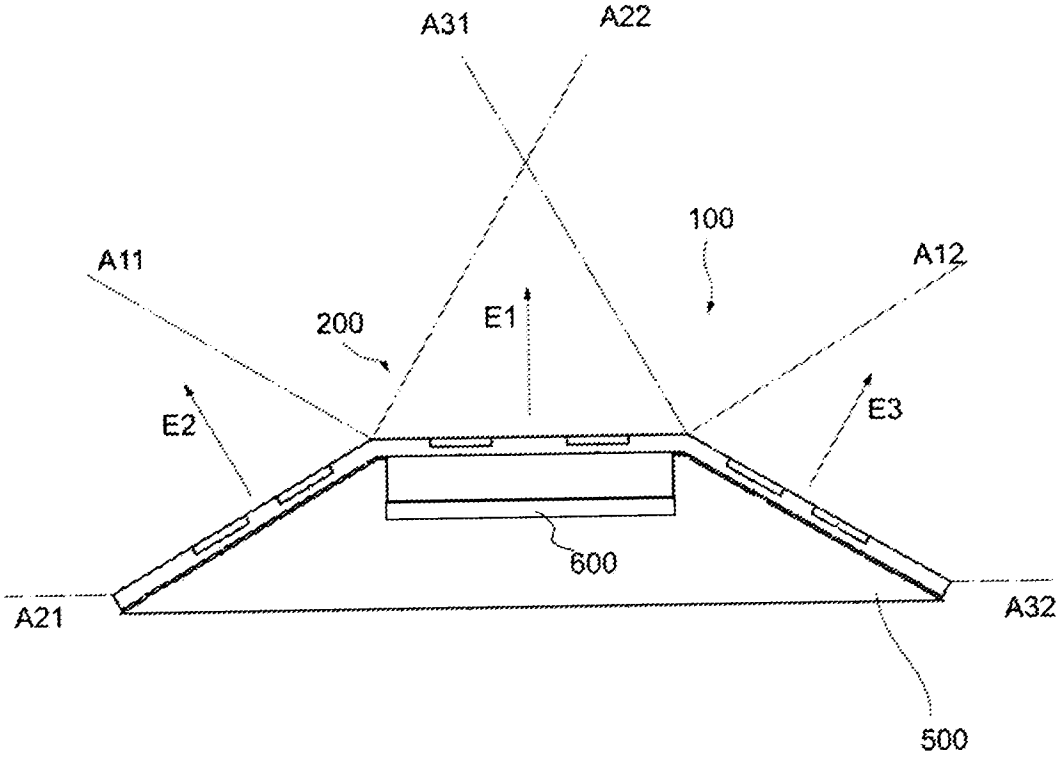
Figure 3C:
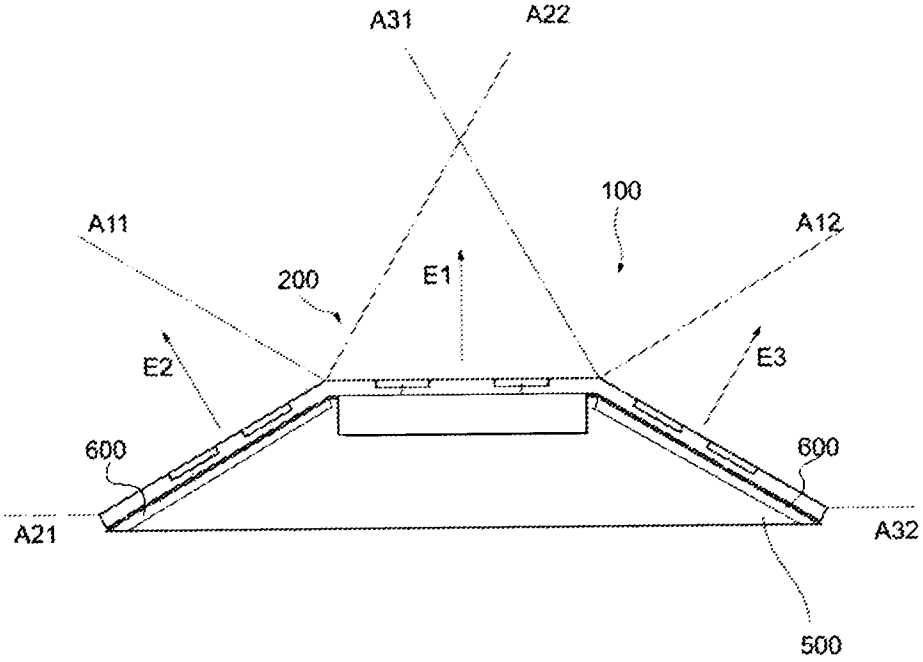

As illustrated in the sectional views in FIGS. 3A to 3C, in the antenna module 100, the front surface 221 of the substrate part 220 is bent toward the rear surface 212 of the substrate part 210 with respect to the front surface 211 of the substrate part 210. The front surface 231 of the substrate part 230 is bent toward the rear surface 212 with respect to the front surface 211. The substrate parts 240 and 250 are also similarly bent toward the rear surface 212.

As a method of bending the substrate parts 220, 230, 240, and 250, a method in which the substrate parts 220, 230, 240, and 250 are bent by applying heat to dielectric substrate 200 can be used. Furthermore, a method in which the substrate parts 220, 230, 240, and 250 are bent by providing grooves in the rear surface of the dielectric substrate 200 prior to bending and then bending the dielectric substrate 200 so that the grooves become narrower may be considered.

The patch antennas 300 are arranged on the front surface of the dielectric substrate 200. Specifically, the patch antennas 300 are arranged on the front surfaces 211, 221, 231, 241, and 251 of the substrate parts 210, 220, 230, 240, and 250. Therefore, the radiation directions of the respective antenna groups are different from each other and consist of a radiation direction E1 of the antenna group 310, a radiation direction E2 of the antenna group 320, and a radiation direction E3 of the antenna group 330.

Figure 34:
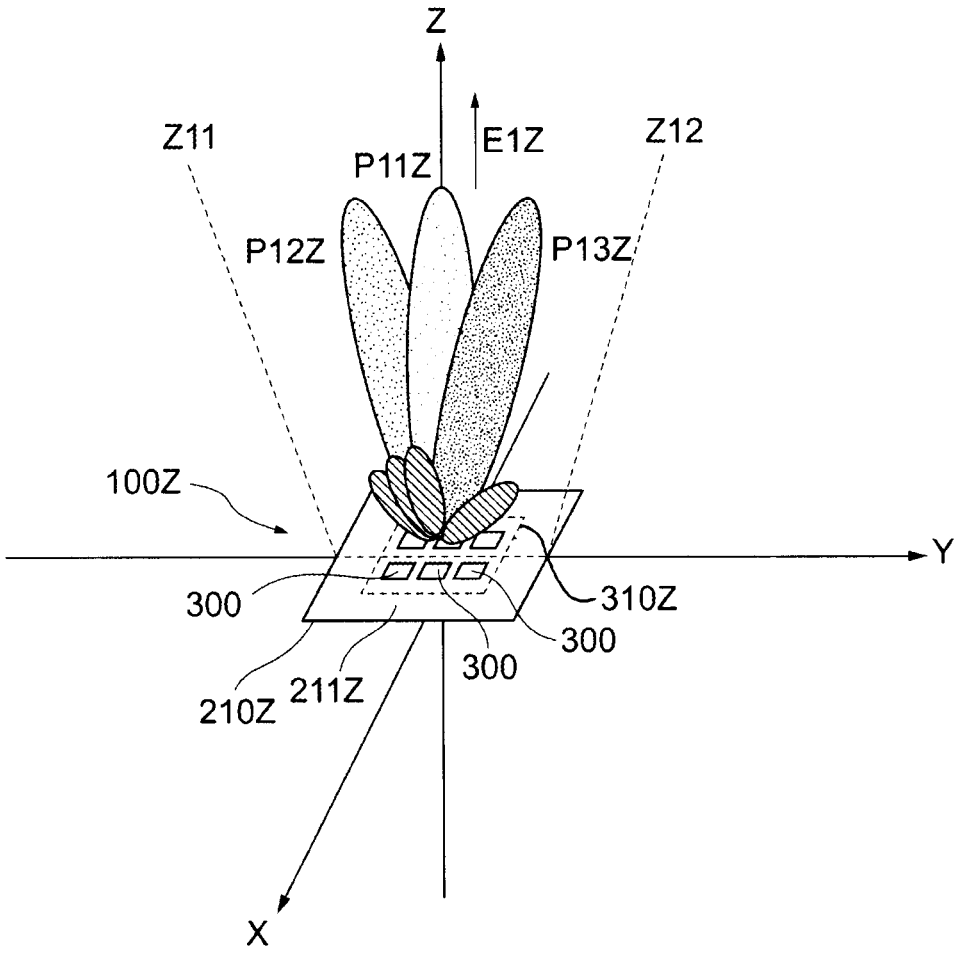
FIG. 34 is a diagram for explaining radiation of radio waves by an antenna module of a comparative example.

Here, an antenna module 100Z of a comparative example will be described while referring to FIG. 34. The antenna module 100Z is arranged so that a front surface 211Z of a substrate part 210Z, which is a dielectric substrate, faces in a positive Z axis direction in an orthogonal coordinate system. In the antenna module 100Z, an integrated circuit (not illustrated) is arranged on a rear surface of the substrate part 210Z and transmission and reception of radio waves by an antenna group 310Z is controlled by the integrated circuit.

The antenna module 100Z can radiate radio waves as illustrated as a radio wave range P11Z in the positive Z axis direction.

Furthermore, the antenna module 100Z can perform beam forming control in order to adjust the directivity of the antenna group 310Z. Radio waves radiated by the antenna module 100Z can be changed to a radio wave range P12Z or a radio wave range P13Z by the beam forming control.

The antenna module 100Z can radiate radio waves in a region from a straight line Z11 to a straight line Z12 with the front surface 211Z therebetween in the YZ plane by moving the radio wave range.

A radiation range of the antenna module 100 will be described using FIGS. 3A to 3C. The antenna group 310 can radiate radio waves in a range from a straight line A11 to a straight line A12 with the front surface 211 therebetween, the antenna group 320 can radiate radio waves in a range from a straight line A21 to a straight line A22 with the front surface 221 therebetween, and the antenna group 330 can radiate radio waves in a range from a straight line A31 to a straight line A32 with the front surface 231 therebetween.

Figure 4:
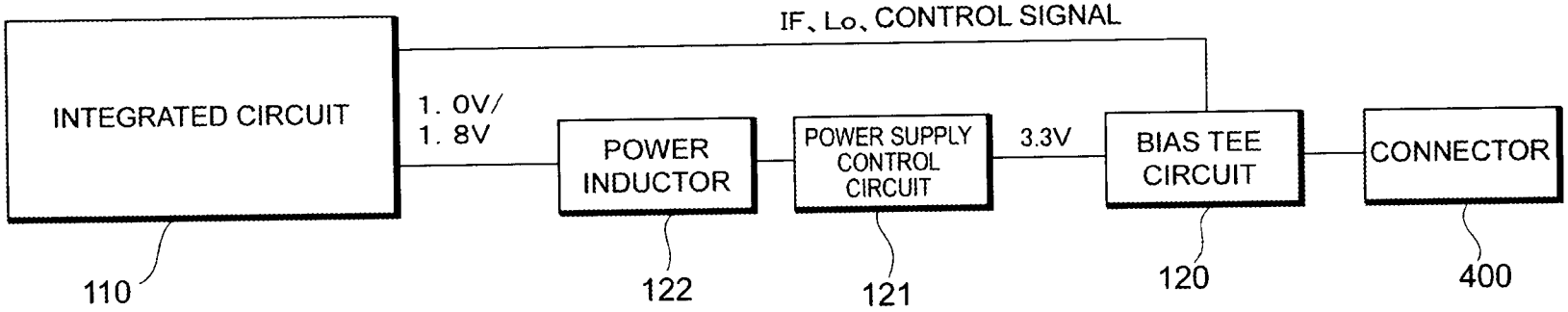
FIG. 4 is a block diagram for explaining the paths of signals in the antenna module according to the first embodiment.

Signals supplied to the integrated circuit 110 via the connector 400 will be described while referring to FIG. 4. Input signals are supplied from a baseband IC (not illustrated) to the connector 400. A direct current signal, which is used as a power source of the integrated circuit 110, a local oscillation signal (Lo), and a control signal are included in the input signals. Furthermore, in the case where superheterodyne method is used, a signal of an intermediate frequency (IF) band would also be included in the input signals.

The local oscillation signal is signal generated in a baseband IC. The local oscillation signal is combined with a reception signal or a transmission signal of the antenna module 100. In the case where a transmission signal is processed using an intermediate frequency band signal, the baseband IC generates an intermediate frequency band signal by combining the local oscillation signal with a transmission signal.

The control signal is a signal that is supplied to the integrated circuit 110 in order to control inputting and outputting of radio waves by the patch antennas 300. The control signal is a signal having a lower frequency than the frequency of the local oscillation signal and the intermediate frequency.

In the case where the connector 400 is a coaxial connector, the individual signals constituting the input signal are supplied to the connector 400 in a superimposed state. The voltage of the direct current signal is around 3.3 V, for example. The frequency of the local oscillation signal is several GHz, for example. The frequency of the intermediate frequency signal is ten or a few more than ten GHz, for example. The frequency of the control signal is several hundred MHz, for example.

A direct current component of the signal supplied to the connector 400 is extracted by bias tee circuit 120 and is inputted to the power supply control circuit 121. A power supply voltage obtained through voltage conversion performed by the power supply control circuit 121 and the power inductor 122 is supplied to the integrated circuit 110. The power supply voltage supplied to the integrated circuit 110 is around 1.0 V or 1.8 V, for example.

Figure 5:
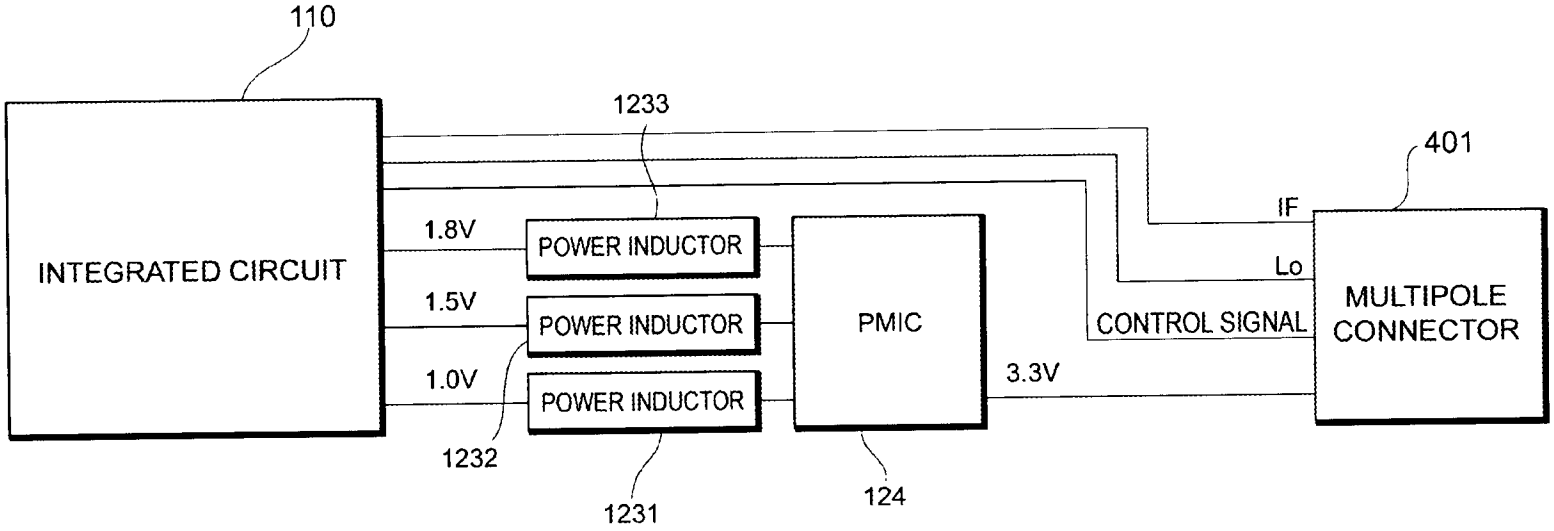
FIG. 5 is a block diagram for explaining the paths of signals in the antenna module when a multipole connector is used.

As illustrated in FIG. 5, the connector 400 may be interchanged with a multipole connector 401. In the case where a multipole connector 401 is used, the power supply voltage is managed by a power management IC (PMIC) 124, which performs power supply management, and power inductors 1231, 1232, and 1233. A plurality of power supply voltages such as 1.8 V, 1.5 V, and 1.0 V can be supplied by the PMIC 124 in accordance with the output of the antenna.

Figure 6:
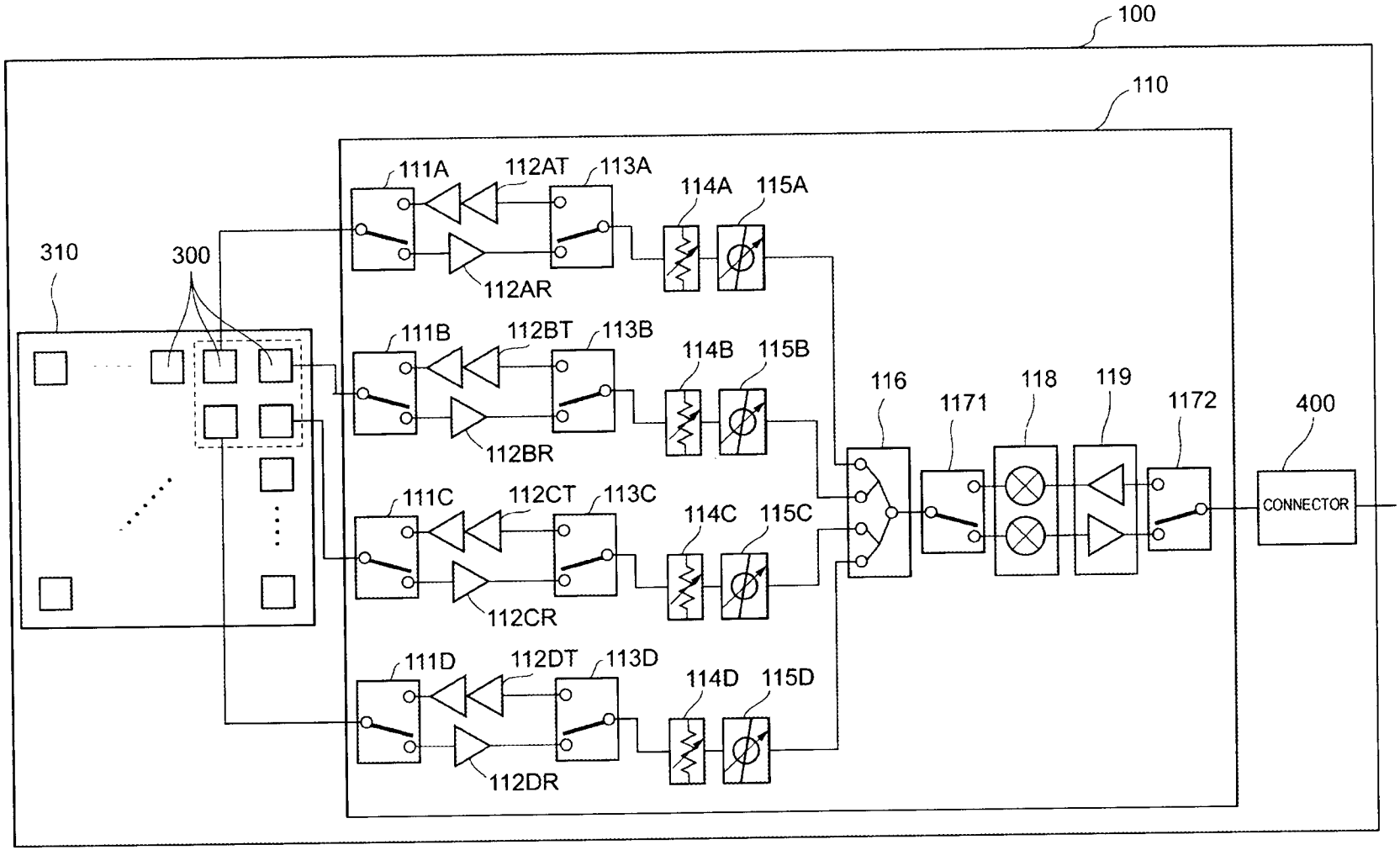
FIG. 6 is a block diagram of an integrated circuit of the antenna module according to the first embodiment.

FIG. 6 is a block diagram of the antenna module 100 according to the first embodiment. The integrated circuit 110 will be described while referring to FIG. 6.

In FIG. 6, for simplicity of explanation, only the part of the configuration corresponding to four patch antennas 300 out of the plurality of patch antennas 300 constituting the antenna group 310 is illustrated and the parts of the configuration corresponding to the other patch antennas 300 having the same configuration are omitted. Furthermore, in FIG. 6, only the part of the configuration corresponding to the antenna group 310 is illustrated out of the configuration of the integrated circuit 110.

FIG. 6 illustrates the integrated circuit 110, and the antenna group 310, and the connector 400. The antenna module 100 upconverts a signal inputted to the antenna module 100 via the connector 400 into a radio-frequency signal and radiates the radio-frequency signal from the antenna group 310. The antenna module 100 downconverts a radio-frequency signal received by the antenna group 310 and outputs the down-converted signal via the connector 400.

The integrated circuit 110 includes switches 111A to 111D, 113A to 113D, 1171, and 1172, power amplifiers 112AT to 112DT, low-noise amplifiers 112AR to 112DR, attenuators 114A to 114D, phase shifters 115A to 115D, a signal multiplexer/demultiplexer 116, a mixer 118, and an amplification circuit 119.

In the case where a radio-frequency signal is to be transmitted, the switches 111A to 111D and 113A to 113D are switched to the power amplifiers 112AT to 112DT and the switch 1171 and the switch 1172 are connected to a transmission-side amplifier of the amplification circuit 119. In the case where a radio-frequency signal is to be received, the switches 111A to 111D and 113A to 113D are switched to the low-noise amplifiers 112AR to 112DR and the switch 1171 and the switch 1172 are connected to a reception-side amplifier of the amplification circuit 119.

A signal inputted to the connector 400 is amplified by the amplification circuit 119 and upconverted by the mixer 118. A transmission signal, which is an upconverted radio-frequency signal, is divided into four signals by the signal multiplexer/demultiplexer 116, and the four signals pass along four signal paths and are respectively supplied to different patch antennas 300. At this time, the directivity of the antenna group 310 can be adjusted by individually adjusting the phases of the phase shifters 115A to 115D arranged on the respective signal paths.

Reception signals, which are radio-frequency signals received by the patch antennas 300, pass along four different signal paths and are multiplexed by the signal multiplexer/demultiplexer 116. The multiplexed reception signal is downconverted by the mixer 118, amplified by the amplification circuit 119, and is outputted from the connector 400.

The integrated circuit 110 is formed as an integrated circuit component consisting of one chip including the above-described circuit configuration, for example. Alternatively, devices in the integrated circuit 110 corresponding to the patch antennas 300 (switches, power amplifiers, low-noise amplifiers, attenuators, and phase shifters) may be formed as a chip integrated circuit component consisting of one chip for each corresponding patch antenna 300.

Figure 7:
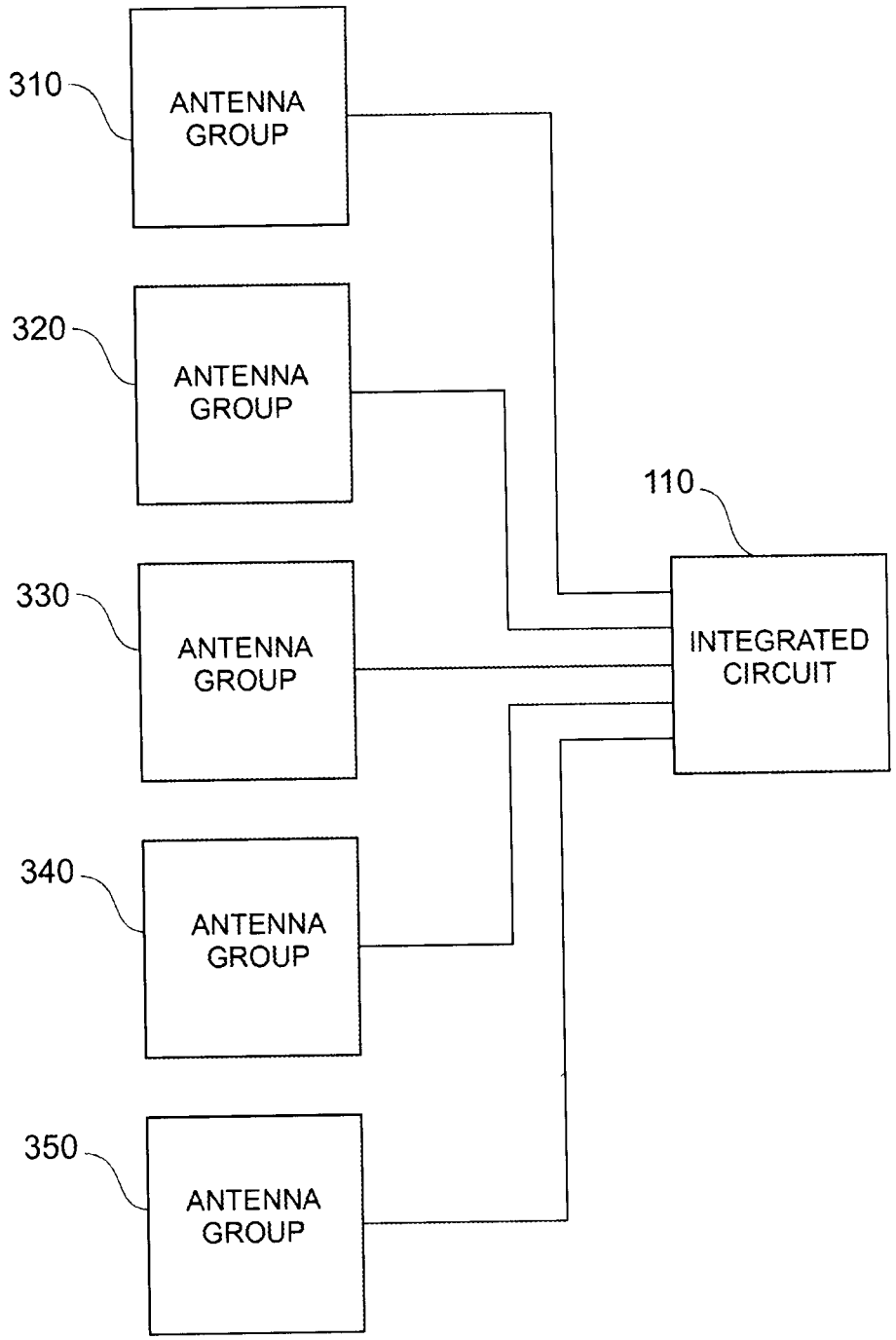
FIG. 7 is a block diagram of the antenna module according to the first embodiment.

As illustrated in FIG. 7, in addition to being connected to the antenna group 310, the integrated circuit 110 is also connected to the antenna groups 320, 330, 340, and 350. The integrated circuit 110 controls transmission and reception of radio waves for the antenna groups 320, 330, 340, and 350 in the same manner as for the antenna group 310.

The antenna module 100 is configured so as to be capable of radiating radio waves in a plurality of directions such as the radiation directions E1, E2, and E3 in FIGS. 3A to 3C as a result of the antenna groups 310, 320, 330, 340, and 350 being controlled by the integrated circuit 110.

The differences from the case where radio waves are radiated in just one direction as in the antenna module 100Z in FIG. 34 will be described. It is assumed that the same amount of power is supplied to the antenna module 100 and the antenna module 100Z. In the case of the antenna module 100Z, since radio waves are radiated in only one direction from the antenna group 310Z in response to the supplied power, the possible radiation range of the antenna is long in the positive Z axis direction in FIG. 34.

On the other hand, in the antenna module 100, radio waves are radiated from the patch antennas 300 arranged in the plurality of antenna groups 310, 320, 330, 340, and 350. In the case where the same amount of power is supplied to the antenna module 100 as to the antenna module 100Z, the power supplied to each of the antenna groups 310, 320, 330, 340, and 350 is smaller than the power supplied to the antenna group 310Z. When the amount of power supplied to each antenna group becomes smaller, the radio waves radiated from each antenna group reach positions that are nearer to each antenna group.

In the antenna module 100, the radiation directions of the antenna group are different from each other such as the radiation directions E1, E2, and E3. Therefore, the angular range over which radio waves can be transmitted and received, i.e., the coverage, is wider in the antenna module 100 than in the antenna module 100Z.

When the same amount of the supplied power is received using one integrated circuit 110, the antenna module 100 can realize wider coverage than the antenna module 100Z, which radiates radio waves in one direction.

For example, a case can be considered in which the antenna module 100 is used for a communication device such as a mobile terminal such as a mobile phone, a smart phone, a tablet or the like or a personal computer having a communication function. In these communication devices, the posture of the communication device may change during use and it is desirable that the coverage of the antenna module be wide so as to be able to handle these changes.

The coverage of the antenna module 100 is wider than that of the antenna module 100Z. Therefore, the communication range required by such a communication device can be secured using a smaller number of antenna modules 100.

Furthermore, when using the antenna module 100Z, it would be necessary to point a plurality of antenna modules 100Z in a plurality of directions in order to obtain the same coverage as the antenna module 100. In other words, since it is possible to realize the same coverage as a plurality of antenna module 100Z while using a smaller number of antenna modules 100, space saving is possible with respect to the modules.

In the second embodiment and embodiments subsequent thereto, the description of the matters common to the first embodiment will be omitted and only the differences will be described. In particular, the same operational effects resulting from the same configurations will not be repeatedly described in the individual embodiments.

An antenna module 100A according to a second embodiment will be described while referring to FIGS. 8 and 9. The antenna module 100A is also provided with the integrated circuit 110, the heat-radiating member 500, and the connection members 600, but the illustration thereof is omitted from FIGS. 8 and 9. In the antenna module 100A, the patch antennas 300 are arranged on a dielectric substrate 200A. The dielectric substrate 200 includes substrate parts 210A, 220A, and 230A.

Figure 8:
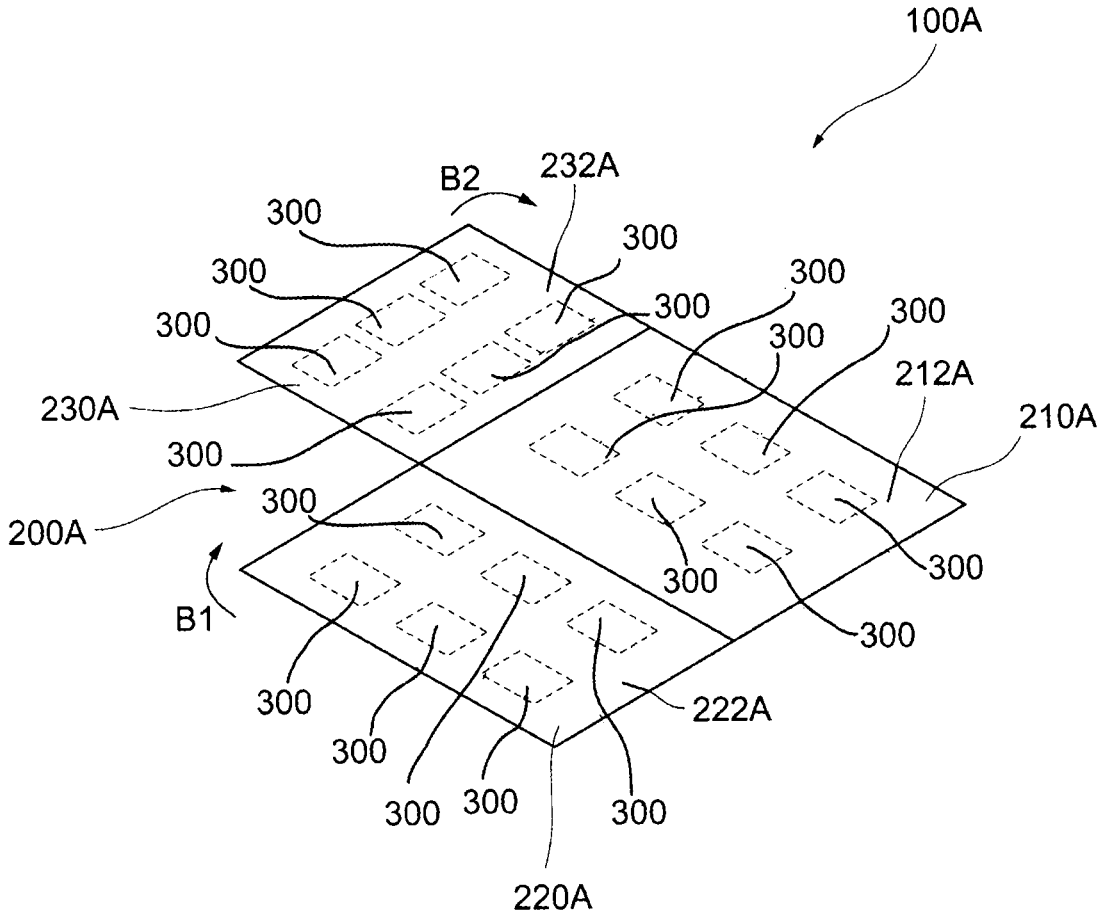
FIG. 8 is an expanded view of an antenna module according to a second embodiment.

FIG. 8 is an expanded view in which the substrate parts 210A, 220A, and 230A are expanded in the same plane. The expanded views referred to in this and subsequent embodiments illustrate a state that exists prior to the bending of the substrate parts of the antenna module. The substrate part 210A corresponds to a first substrate part in the Claims. The substrate part 220A corresponds to a second substrate part or a third substrate part in the Claims. The substrate part 230A corresponds to a second substrate part or a third substrate part in the Claims.

In FIG. 8, the substrate parts 210A, 220A, and 230A are illustrated so that rear surfaces 212A, 222A, and 232A thereof can be seen. The antenna module 100A is formed by bending the substrate part 220A at 90° in the direction of arrow B1 and by bending the substrate part 230A at 90° in the direction of arrow B2.

Figure 9:
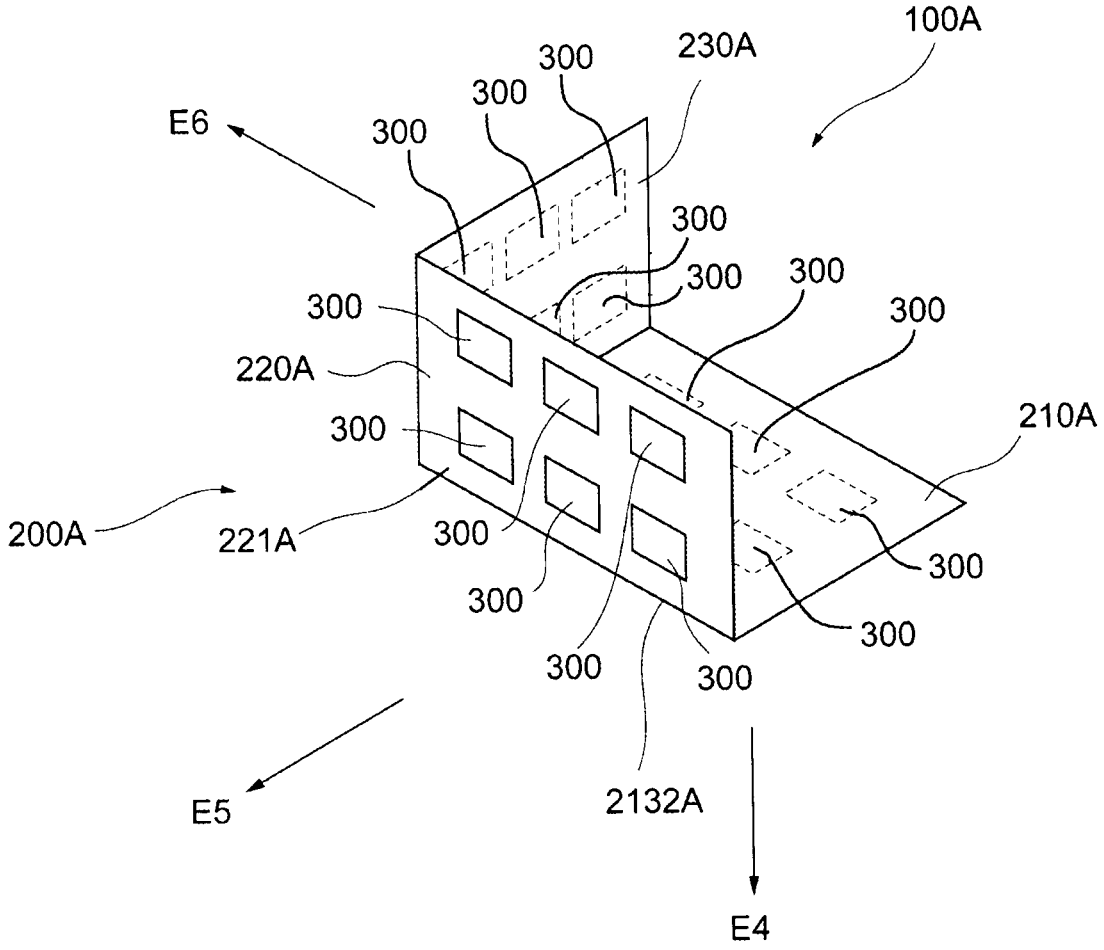
FIG. 9 is a diagram for explaining radiation of radio waves by the antenna module according to the second embodiment.

As illustrated in FIG. 9, radio waves are radiated in a radiation direction E4 by the patch antennas 300 arranged on the substrate part 210A. Radio waves are radiated in a radiation direction E5 by the patch antennas 300 arranged on the substrate part 220A. Radio waves are radiated in a radiation direction E6 by the patch antennas 300 arranged on the substrate part 230A.

Since the antenna module 100A is able to radiate radio waves in the three radiation directions E4, E5, and E6, the antenna module 100A also realizes improved antenna module coverage.

Figure 10:
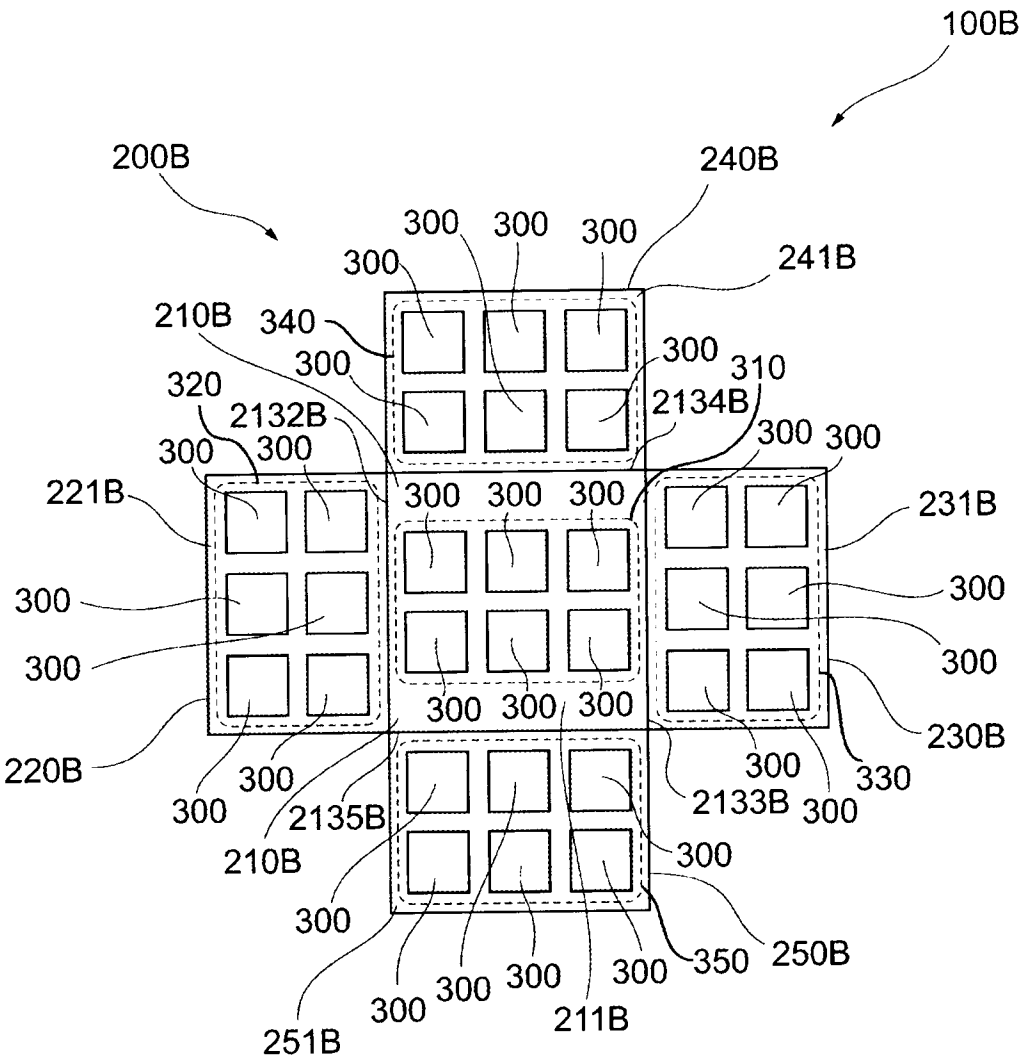
FIG. 10 is an expanded view of an antenna module according to a third embodiment.

An antenna module 100B according to a third embodiment will be described while referring to FIGS. 10 and 11. FIG. 10 is an expanded view seen from the front surface side of the antenna module 100B. The antenna module 100B has an integrated circuit and a connector (not illustrated) on the rear surface thereof. The antenna module 100B differs from the antenna module 100 according to the first embodiment with respect to the way in which substrate parts 220B, 230B, 240B, and 250B are bent.

A front surface 221B of the substrate part 220B is bent at 90° with respect to a front surface 211B of the substrate part 210B toward the rear surface of the substrate part 210B. A front surface 231B of the substrate part 230B is bent at 90° with respect to the front surface 211B of the substrate part 210B toward the rear surface of the substrate part 210B. Similarly, front surfaces 241B and 251B of the substrate parts 240B and 250B are bent at 90° toward the rear surface of the substrate part 210B.

Figure 11:
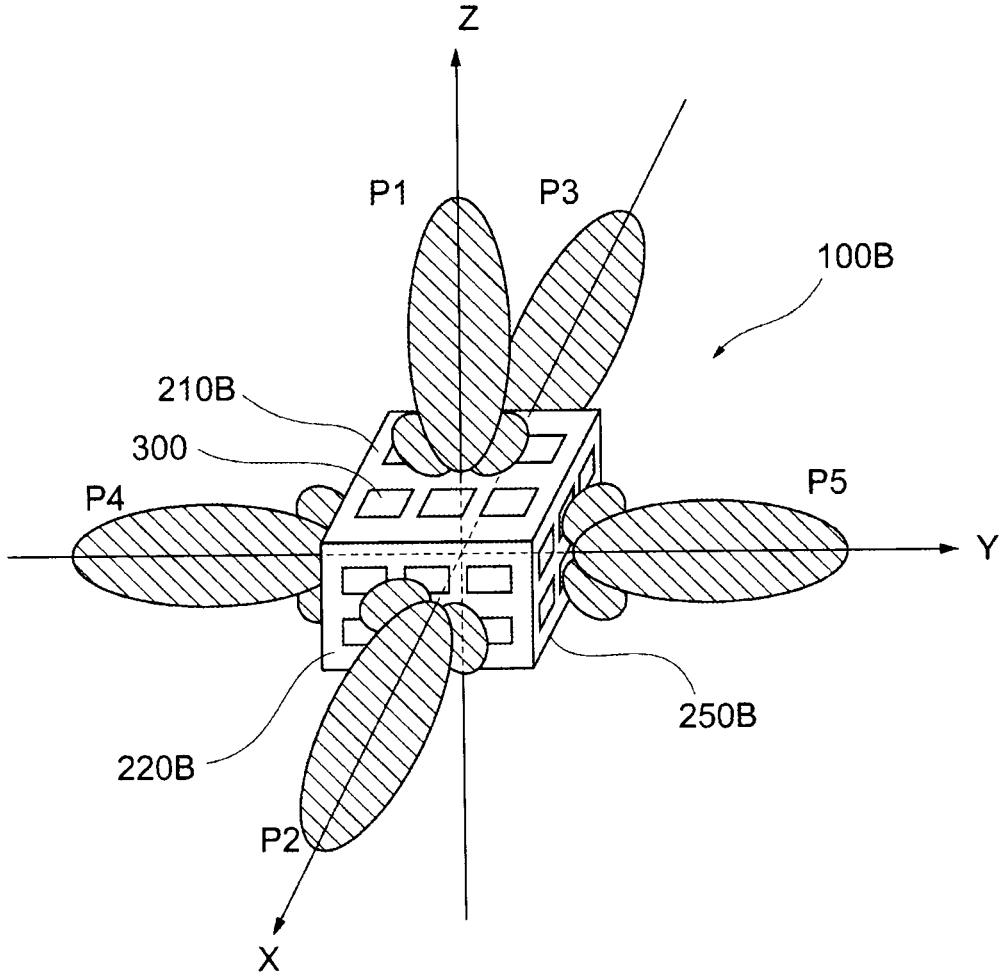
FIG. 11 is a diagram for explaining radiation of radio waves by the antenna module according to the third embodiment.

FIG. 11 illustrates a state in which the antenna module 100B is arranged in an orthogonal coordinate system with the substrate part 210B facing in the positive Z axis direction. The antenna module 100B is a body having five surfaces in which one surface has been removed from a rectangular parallelepiped. The substrate part 210B corresponds to a first substrate part in the Claims. The substrate part 220B, 230B, 240B, and 250B each correspond to a second substrate part or a third substrate part in the Claims.

In the antenna module 100B, radio waves are radiated in a radio wave range P1 in the positive Z axis direction from the patch antennas 300 arranged on the substrate part 210B. The substrate part 220B radiates radio waves in a radio wave range P2 in the positive X axis direction and the substrate part 230B (not illustrated) radiates radio waves in a radio wave range P3 in the negative X axis direction. The substrate part 240B (not illustrated) radiates radio waves in a radio wave range P4 in the negative Y axis direction and the substrate part 250B radiates radio waves in a radio wave range P5 in the positive Y axis direction.

Wider coverage can be realized in the antenna module 100B as well due to the dielectric substrate 200B being formed of the substrate parts 210B, 220B, 230B, 240B, and 250B so that the dielectric substrate 200B is able to point in a plurality of directions.

Figure 12:
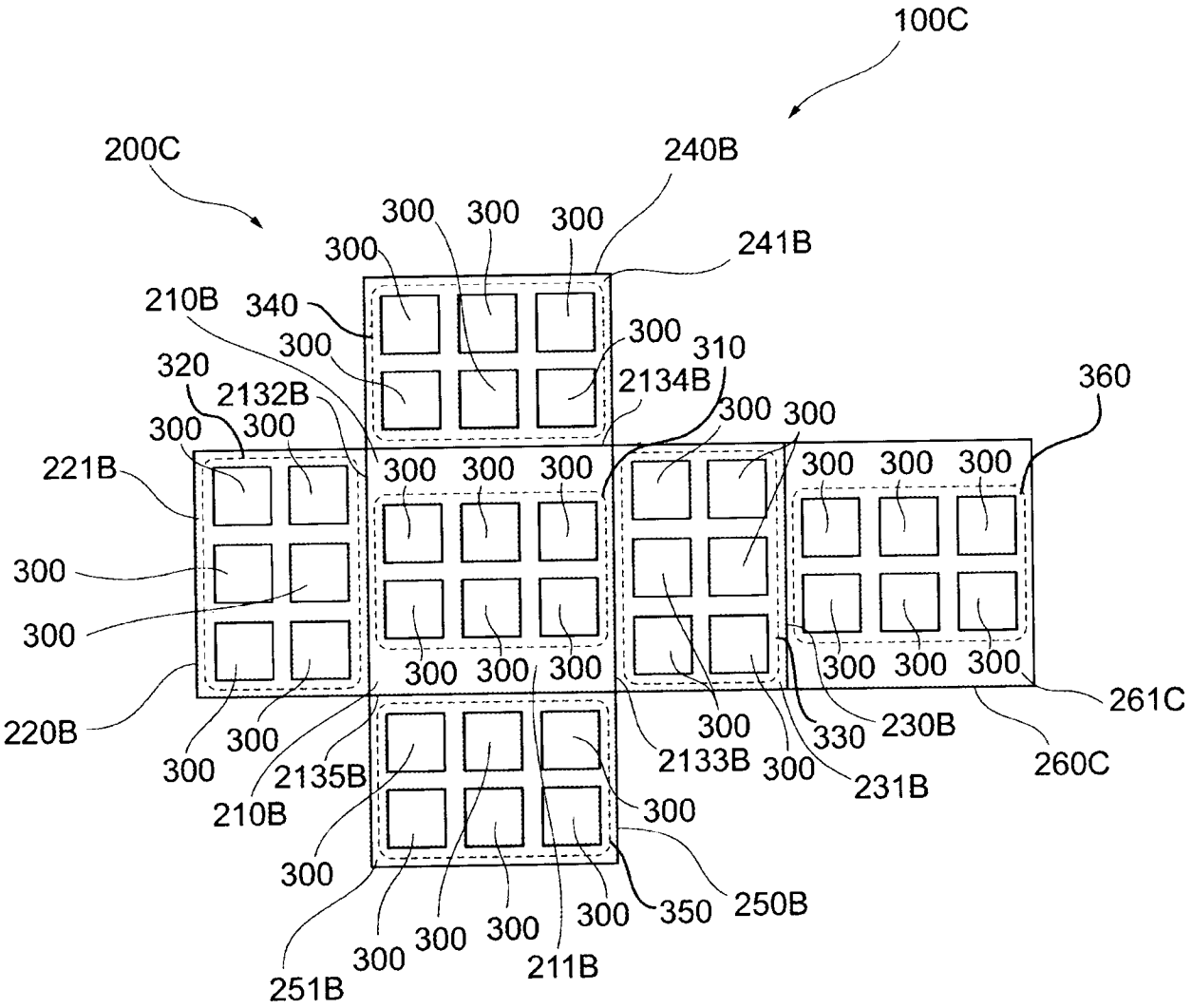
FIG. 12 is an expanded view of an antenna module according to a modification of the third embodiment.

An antenna module 100C, which is a modification of the antenna module 100B, will be described while referring to FIGS. 12 and 13. As illustrated in the expanded view of FIG. 12, a dielectric substrate 200C includes a substrate part 260C that extends from the substrate part 230B. An antenna group 360 composed of a plurality of patch antennas 300 is arranged on a front surface 261C of the substrate part 260C. The antenna module 100C has an integrated circuit and a connector (not illustrated) on the rear surface thereof. The substrate part 260C corresponds to a second substrate part or a third substrate part in the Claims.

The substrate parts 220B to 250B are bent in the same manner as in the antenna module 100B. The substrate part 260C is bent at 90° toward the rear surface of the substrate part 230B. The substrate part 260C faces the substrate part 210B in a bent state.

Figure 13:
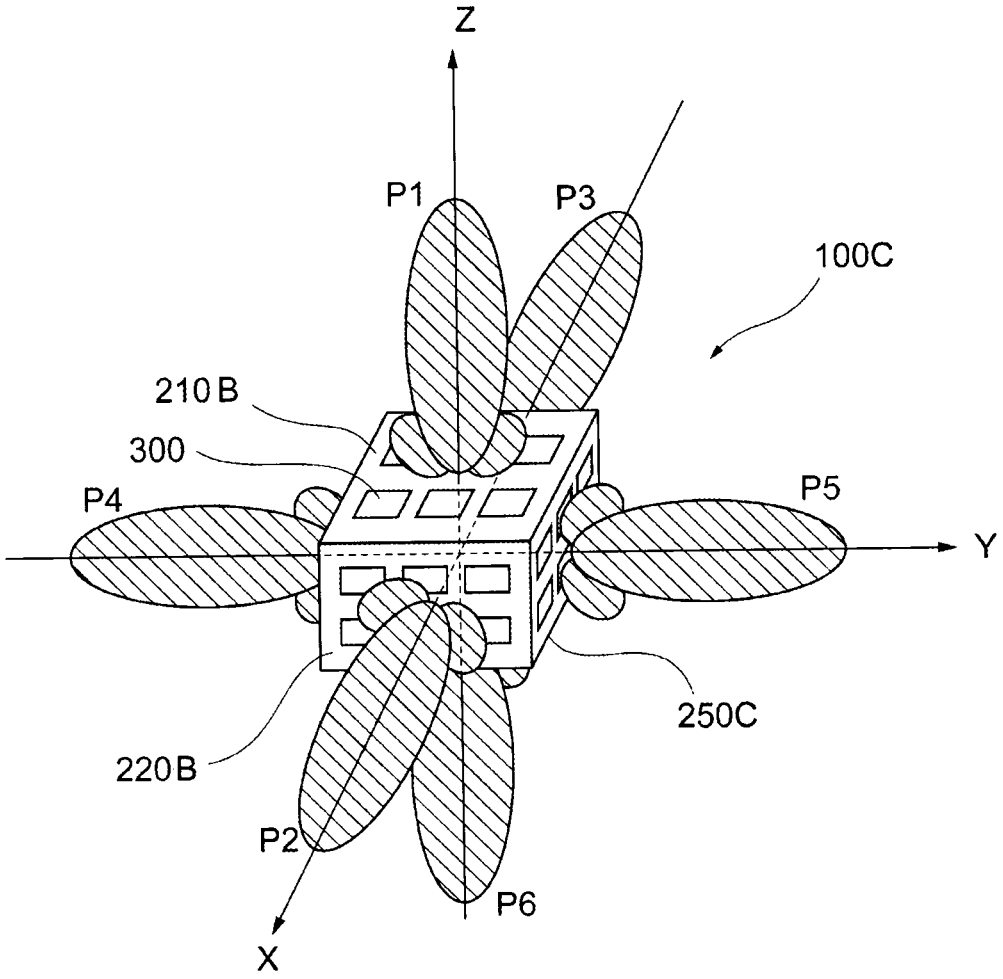
FIG. 13 is a diagram for explaining radiation of radio waves by the antenna module according to the modification of the third embodiment.

FIG. 13 illustrates a state in which the antenna module 100C is arranged in an orthogonal coordinate system with the substrate part 210B facing in the positive Z axis direction. The shape of the antenna module 100C is a substantially rectangular parallelepiped shaped hexahedron.

In addition to the radio wave ranges P1, P2, P3, P4, and P5, the antenna module 100C radiates radio waves in a radio wave range P6 in the negative Z axis direction from the antenna group 360 arranged on the substrate part 260C. The antenna module 100C is also able to realize wider coverage.

Figure 14:
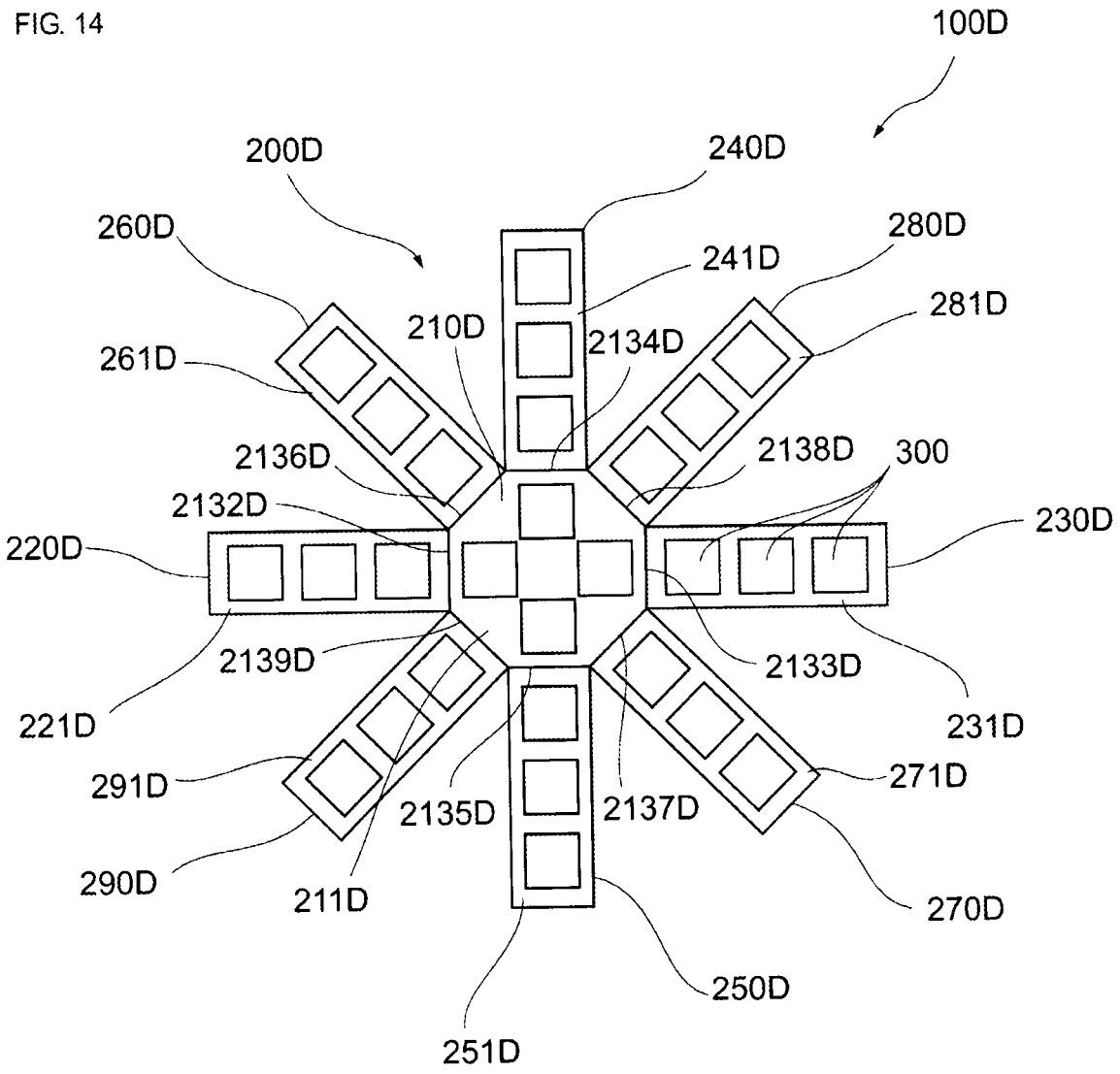
FIG. 14 is a plan view of an antenna module according to a fourth embodiment.

An antenna module 100D according to a fourth embodiment will be described while referring to FIG. 14. FIG. 14 illustrates a plan view seen from the front surface side of the antenna module 100D. The antenna module 100D has an integrated circuit and a connector (not illustrated) on the rear surface thereof.

A dielectric substrate 200D of the antenna module 100D includes substrate parts 210D, 220D, 230D, 240D, 250D, 260D, 270D, 280D, and 290D. A front surface 211D of the substrate part 210D has a substantially octagonal shape. The front surface 211D has edges 2132D, 2133D, 2134D, 2135D, 2136D, 2137D, 2138D, and 2139D. The substrate part 210D corresponds to a first substrate part in the Claims. The substrate parts 220D, 230D, 240D, 250D, 260D, 270D, 280D, and 290D each correspond to a second substrate part or a third substrate part in the Claims.

The substrate part 220D is formed so as to extend from the edge 2132D. In the embodiments disclosed in this specification, the term "extend" is used to refer to the extension from an inner side of a certain substrate part toward an outer periphery of the substrate part. In the antenna module 100D, the term "extend" is used to refer to the extension from the inner side of the substantially polygonal substrate part 210D toward the outer periphery of the substrate part 210D.

The substrate part 230D is formed so as to extend from the edge 2133D. The substrate parts 240D to 290D also respectively extend from the edges 2134D to 2139D.

In the antenna module 100D, the substrate parts 220D to 290D are bent toward the rear surface of the substrate part 210D, and the coverage of the antenna module 100D can be thereby improved.

Figure 15:
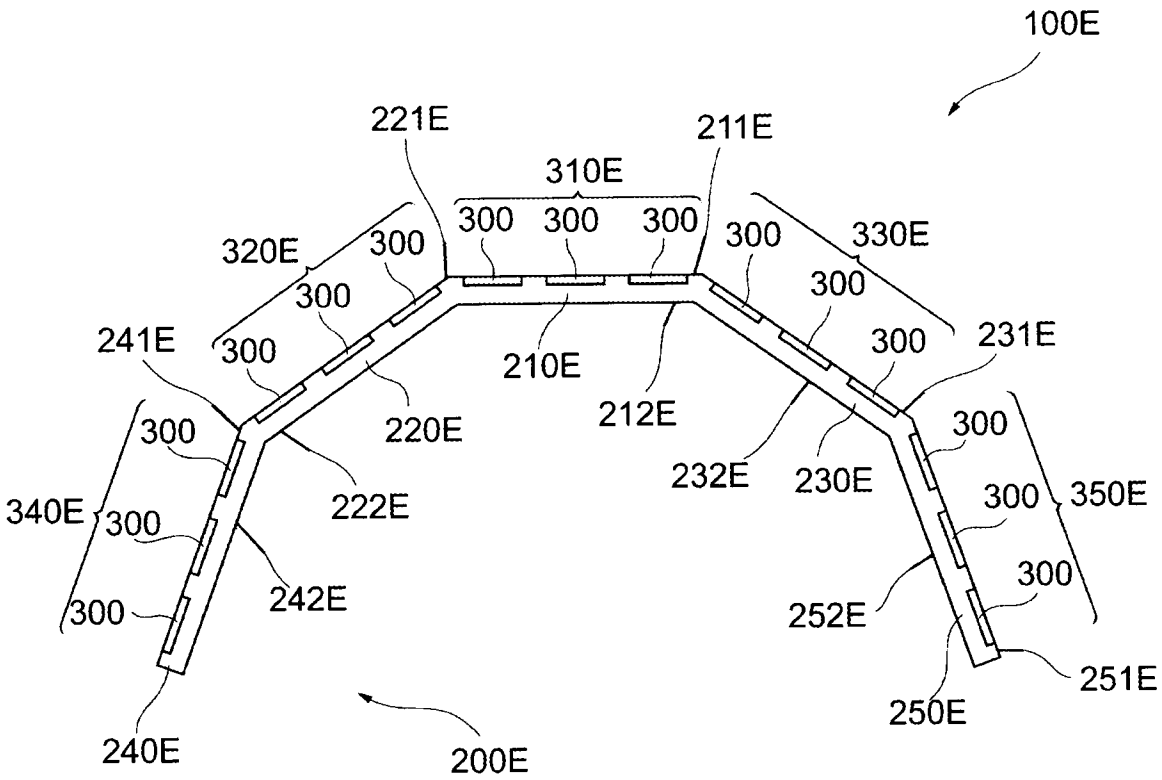
FIG. 15 is a sectional view of an antenna module according to a fifth embodiment.

An antenna module 100E according to a fifth embodiment will be described while referring to FIG. 15. In the fifth embodiment, each substrate part is formed of a substantially rectangular substrate. FIG. 15 is a sectional view of the antenna module 100E according to the fifth embodiment. The sectional view is a sectional view taken along a plane perpendicular to a main surface of each substrate part.

A dielectric substrate 200E of the antenna module 100E includes substrate parts 210E, 220E, 230E, 240E, and 250E. Antenna groups 310E, 320E, 330E, 340E, and 350E, which each include a plurality of patch antennas 300, are arranged on the respective substrate parts. The substrate part 210E corresponds to a first substrate part in the Claims. The other substrate parts each correspond to a second substrate part or a third substrate part in the Claims.

The substrate part 220E is formed so as to extend from an edge 2132E of the substrate part 210E. The substrate part 230E is formed so as to extend from another edge 2133E of the substrate part 210E.

The substrate part 240E is formed so as to extend from the substrate part 220E. The substrate part 250E is formed so as to extend from the substrate part 230E.

A front surface 221E of the substrate part 220E is bent toward a rear surface 212E of the substrate part 210E with respect to a front surface 211E of the substrate part 210E. A front surface 231E of the substrate part 230E is bent toward the rear surface 212E with respect to the front surface 211E.

A front surface 241E of the substrate part 240E is bent toward a rear surface 222E of the substrate part 220E with respect to the front surface 221E of the substrate part 220E. A front surface 251E of the substrate part 250E is bent toward a rear surface 232E with respect to the front surface 231E. In other words, the front surface 241E and 251E are bent toward the rear surface 212E of the substrate part 210E.

In the antenna module 100E, since radio waves can be emitted in five radiation directions by the five substrate parts 210E, 220E, 230E, 240E, and 250E, improved coverage is realized.

Figure 16:
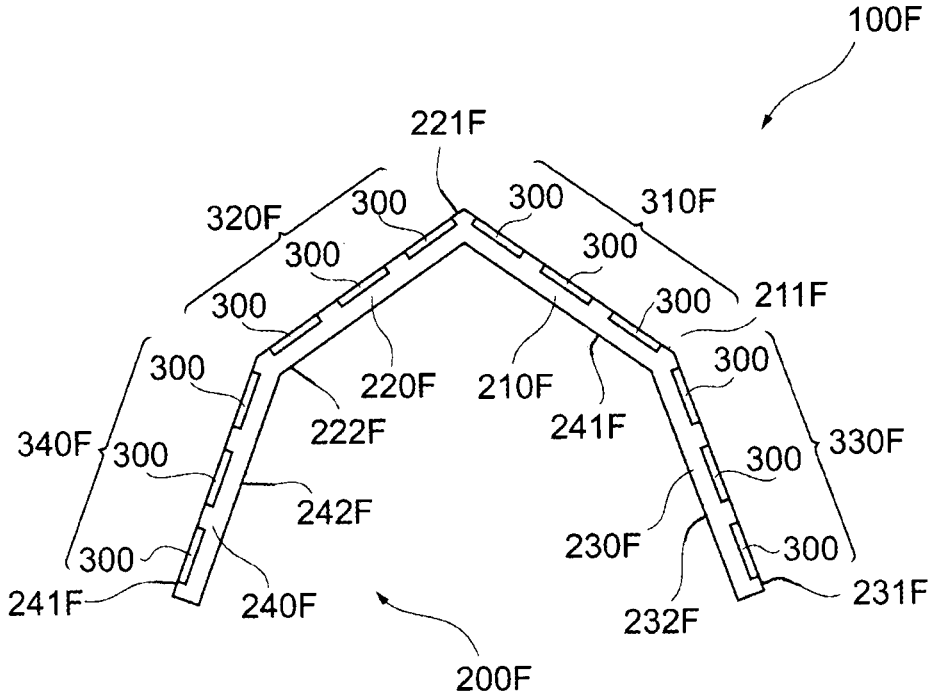
FIG. 16 is a sectional view of an antenna module according to a modification of the fifth embodiment.

In FIG. 16, an antenna module 100F is illustrated as a modification of the antenna module 100E according to the fifth embodiment. The antenna module 100F includes four substrate parts 210F, 220F, 230F, and 240F. In addition, the substrate parts 220F, 230F, and 240F are bent toward a rear surface of the substrate part, similarly to as in the antenna module 100E. Improved coverage can be realized in the antenna module 100F as well. Among the substrate parts 220F, 230F, and 240F, the substrate part on which the integrated circuit and the connector are arranged corresponds to a first substrate part in the Claims and the other substrate parts each correspond to a second substrate part or a third substrate part in the Claims.

Figure 17:
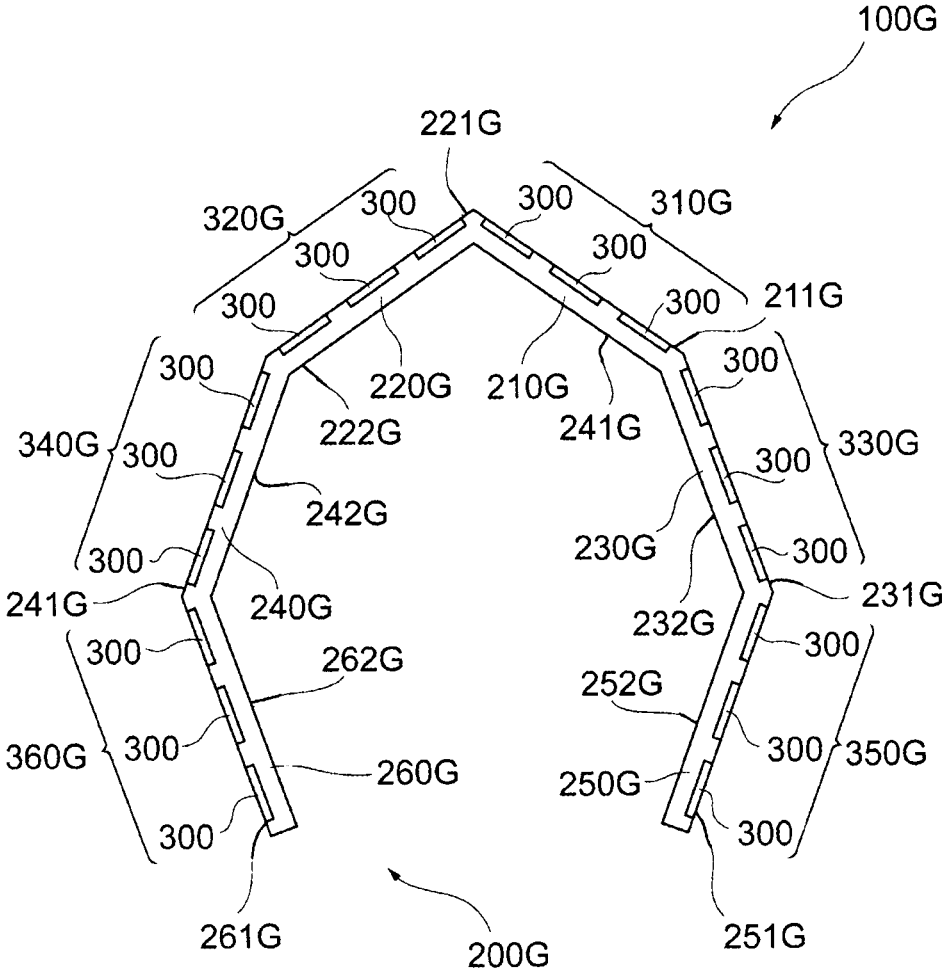
FIG. 17 is a sectional view of the antenna module according to a modification of the fifth embodiment.

In FIG. 17, an antenna module 100G is illustrated as a modification of the antenna module 100E according to the fifth embodiment. The antenna module 100G includes six substrate parts 210G, 220G, 230G, 240G, 250G, and 260G. Furthermore, the substrate parts 220G, 230G, 240G, 250G, and 260G are bent toward a rear surface of the substrate part similarly to as in the antenna module 100G. Improved coverage can be realized in the antenna module 100G as well. Among the substrate parts 210G, 220G, 230G, 240G, 250G, and 260G, the substrate part on which the integrated circuit and the connector are arranged corresponds to a first substrate part in the Claims and the other substrate parts each correspond to a second substrate part or a third substrate part in the Claims.

Figure 18:
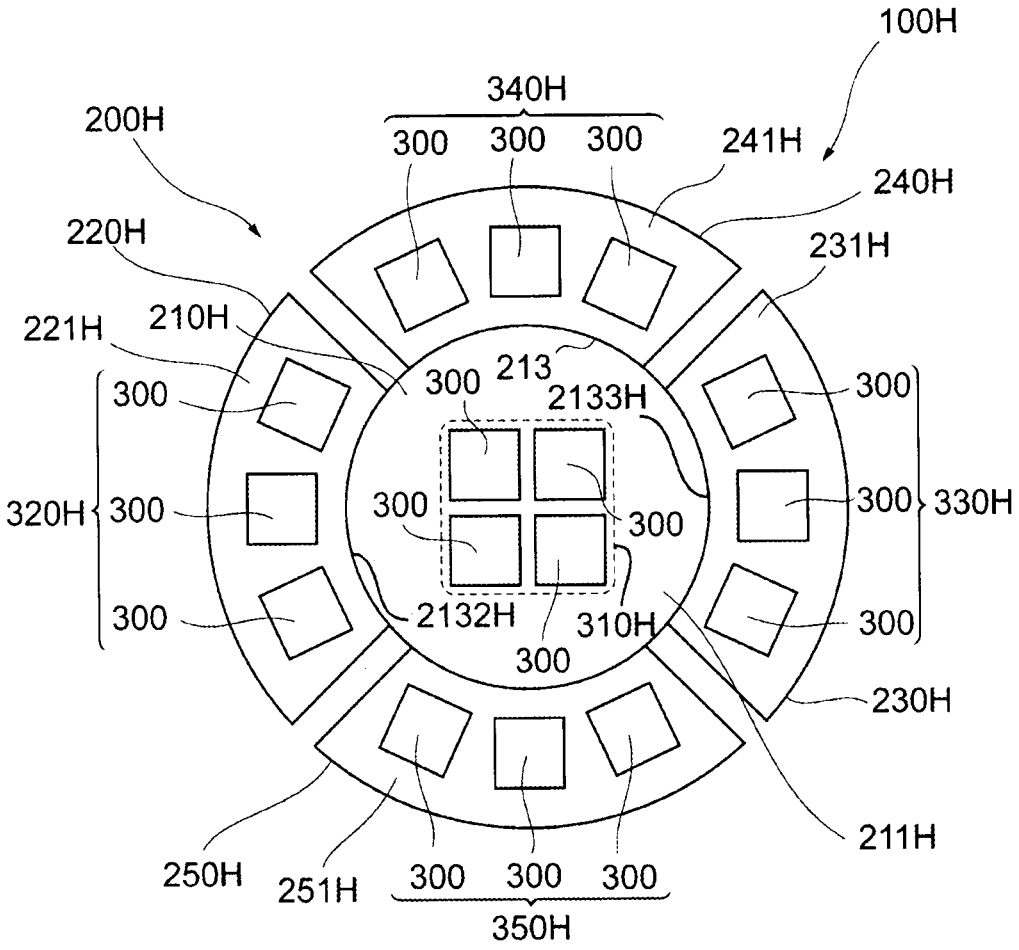
FIG. 18 is a plan view of an antenna module according to a sixth embodiment.

An antenna module 100H according to a sixth embodiment will be described while referring to FIG. 18. FIG. 18 illustrates a plan view seen from the front surface side of the antenna module 100H. The antenna module 100H has an integrated circuit and a connector (not illustrated) on the rear surface thereof.

A dielectric substrate 200H of the antenna module 100H includes substrate parts 210H, 220H, 230H, 240H, and 250H. A front surface 211H of the substrate part 210H has a substantially circular shape. The substrate part 220H is formed so as to extend from one part 2132H of the outer circumference of the circular shape of the front surface 211H. The substrate part 230H is formed so as to extend from one part 2133H of the outer circumference of the circular shape of the front surface 211H.

Antenna groups 310H, 320H, 330H, 340H, and 350H, which are each composed of a plurality of patch antennas 300, are respectively arranged on the front surfaces 211H, 221H, 231H, 241H, and 251H. The substrate part 210H corresponds to a first substrate part in the Claims. The other substrate parts each correspond to a second substrate part or a third substrate part in the Claims.

In the antenna module 100H, the coverage of the antenna module 100H can be improved by bending the substrate parts 220H to 250H toward the rear surface of the substrate part 210H.

Figure 19:
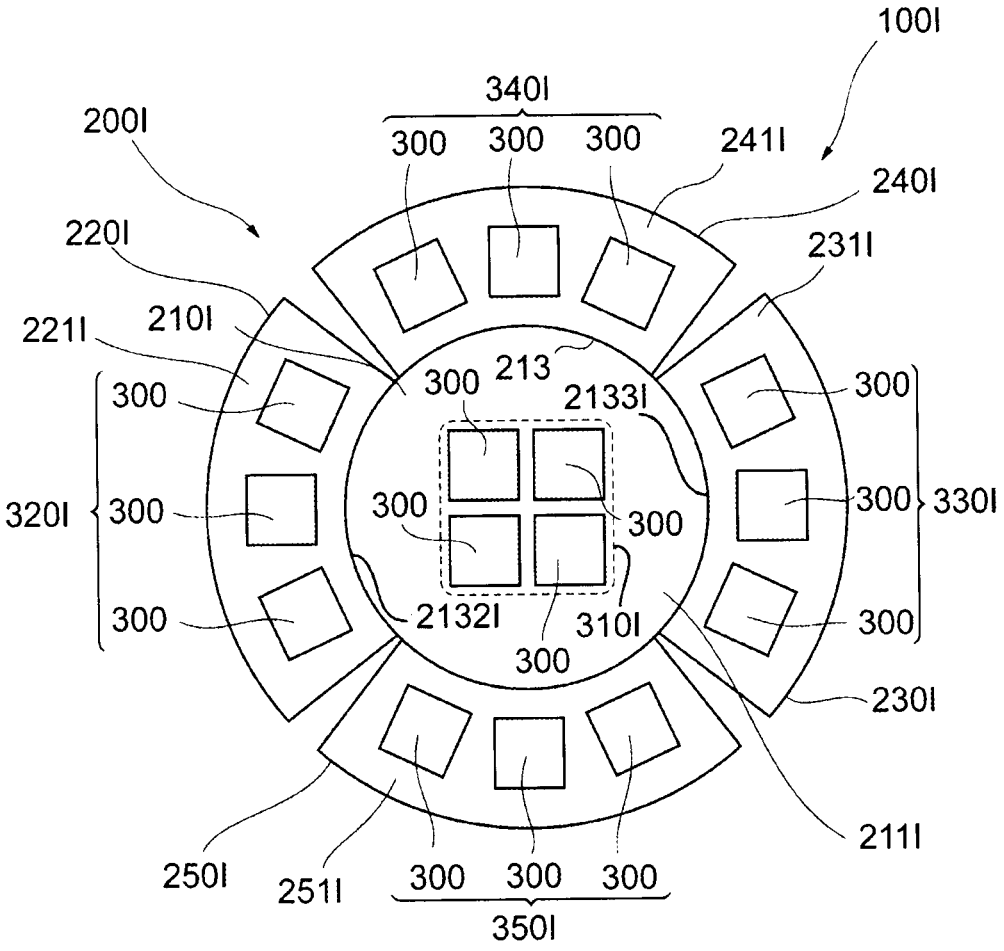
FIG. 19 is a plan view of an antenna module according to a modification of the sixth embodiment.

FIG. 19 illustrates a plan view of an antenna module 100I, which is a modification of the antenna module 100H according to the sixth embodiment. The antenna module 100I includes substrate parts 210I, 220I, 230I, 240I, and 250I. The antenna module 100I differs from the antenna module 100H in that the gaps in circumferential direction between the substrate parts 220I, 230I, 240I, and 250I become narrower with increasing proximity to the substrate part 210I. The substrate part 210I corresponds to a first substrate part in the Claims. The other substrate parts each correspond to a second substrate part or a third substrate part in the Claims.

In the antenna module 100I as well, the coverage of the antenna module 100I can be improved by bending the substrate parts 220I to 250I toward the rear surface of the substrate part 210I.

Figure 20:
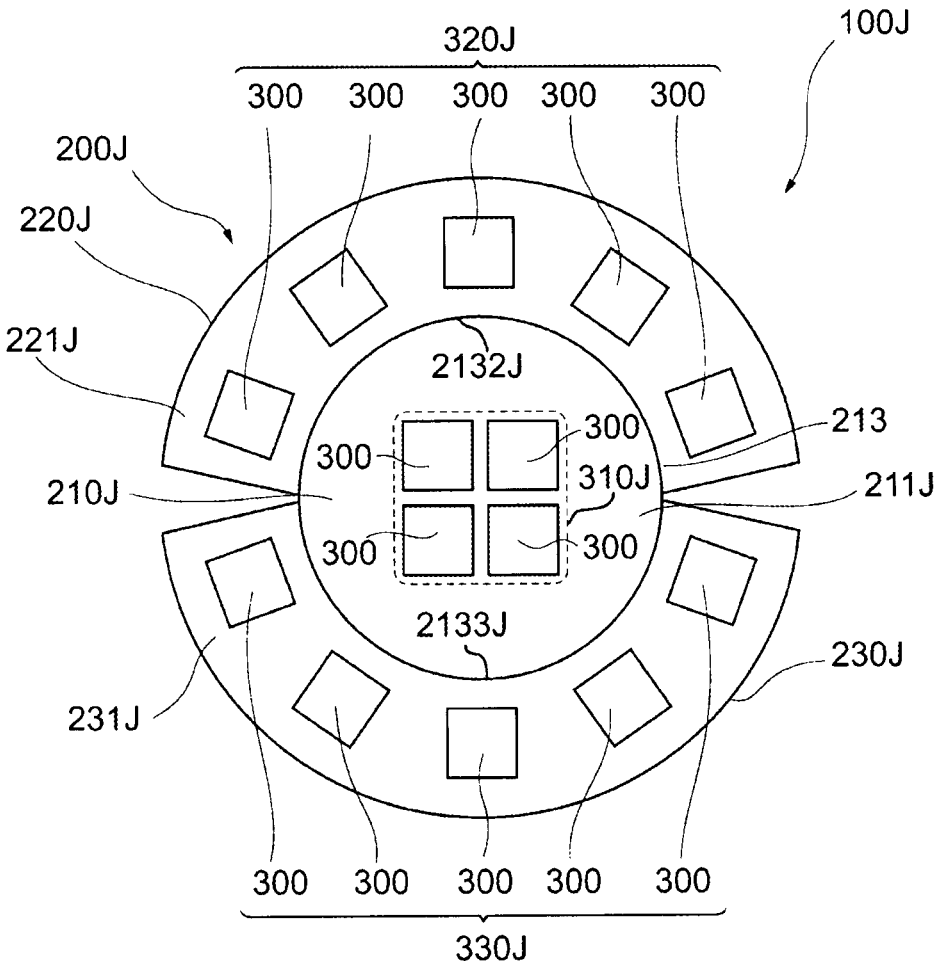
FIG. 20 is a plan view of the antenna module according to a modification of the sixth embodiment.

FIG. 20 illustrates a plan view of an antenna module 100J, which is a modification of the antenna module 100H according to the sixth embodiment. The antenna module 100J includes substrate parts 210J, 220J, and 230J. Antenna groups 310J, 320J, and 330J, which are each composed of a plurality of patch antennas 300, are respectively arranged on the substrate parts 210J, 220J, and 230J.

A front surface 211J of the substrate part 210J has a substantially circular shape. The substrate part 220J is formed so as to extend from one part 2132J of the outer circumference of the circular shape of the front surface 211J. The substrate part 220J is formed so as to extend from one part 2132J of the outer circumference of the circular shape of the front surface 211J. The substrate part 210J corresponds to a first substrate part in the Claims. The other substrate parts each correspond to a second substrate part or a third substrate part in the Claims.

In the antenna module 100J as well, the coverage of the antenna module 100J can be improved by bending the substrate parts 220J and 230J toward the rear surface of the substrate part 210J.

Figure 21:
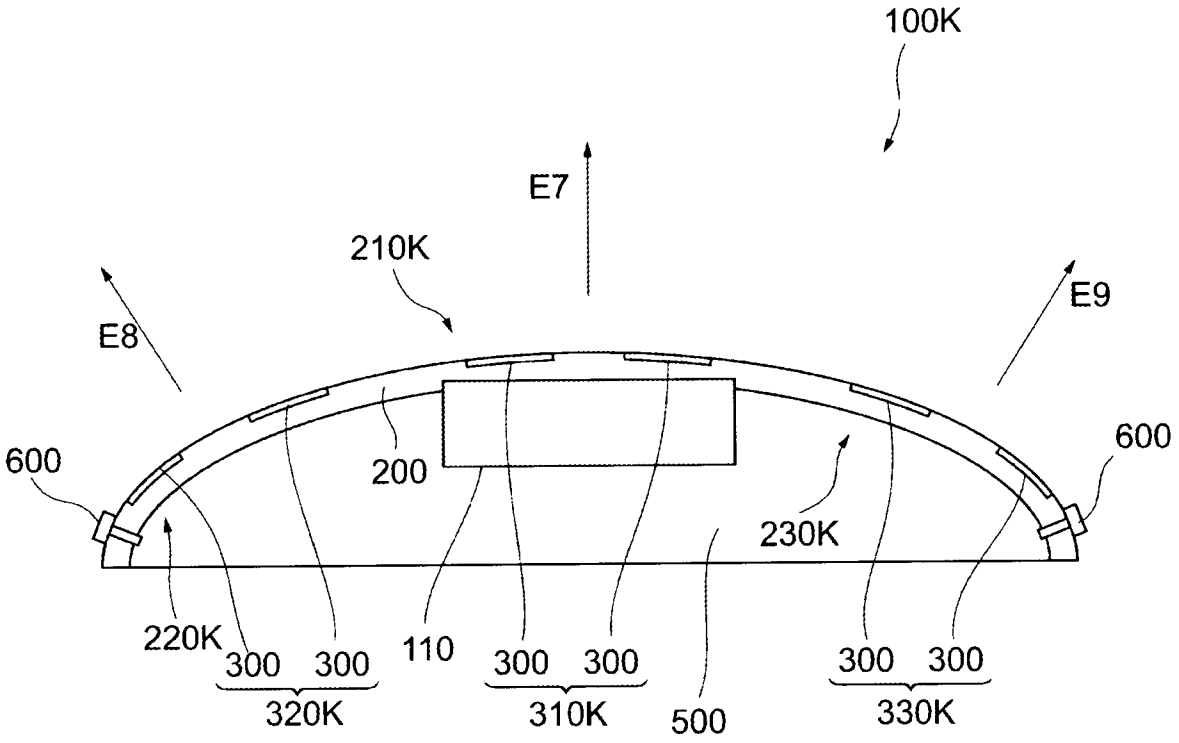
FIG. 21 is a sectional view of an antenna module according to a seventh embodiment.

An antenna module 100K according to a seventh embodiment will be described while referring to FIG. 21. FIG. 21 is a sectional view of the antenna module 100K. The dielectric substrate 200 has a substantially dome-like shape and a sectional view taken along a plane perpendicular to a longitudinal direction is illustrated. The dielectric substrate 200 of the antenna module 100K includes substrate parts 210K, 220K, and 230K that are formed so as to curve in an integrated manner without being folded.

Antenna groups 310K, 320K, and 330K, which are each composed of a plurality of patch antennas 300, are respectively arranged on the substrate parts 210K, 220K, and 230K. The antenna group 310K radiates radio waves in a radiation direction E7, the antenna group 320K radiates radio waves in a radiation direction E8, and the antenna group 330K radiates radio waves in a radiation direction E9. The substrate part 210K corresponds to a first substrate part in the Claims and the substrate parts 220K and 230K each correspond to a second substrate part or a third substrate part in the Claims.

Since the antenna module 100K can radiate radio waves in the plurality of radiation directions E7, E8, and E9, the antenna module 100K realizes improved antenna module coverage as well.

First to seventh embodiments of the present disclosure have been described above. The antenna module 100 includes: the dielectric substrate 200; the plurality of patch antennas 300; the integrated circuit 110 that controls transmission and reception of radio waves by the plurality of patch antennas 300; the connector 400 that is used for inputting and outputting signals between the integrated circuit 110 and the outside; the heat-radiating member 500 that is arranged so as to contact the integrated circuit 110 (heat-radiating member 500 that allows heat generated by the integrated circuit 110 to be radiated); and the connection members 600 that connect the dielectric substrate 200 and the heat-radiating member 500 to each other. The dielectric substrate 200 includes: the substrate part 210 which has the front surface 211 on which the patch antennas 300 of the antenna group 310, out of the plurality of patch antennas 300, are arranged and the rear surface 212 on which the integrated circuit 110 and the connector 400 are arranged; the substrate part 220 which has the front surface 221, on the front surface 211 side of the substrate part 210, on which the patch antennas 300 of the antenna group 320, out of the plurality of patch antennas 300, are arranged; and the substrate part 230 which has the front surface 231, on the front surface 211 of the substrate part 210, on which the patch antennas 300 of the antenna group 330, out of the plurality of patch antennas 300, are arranged. The substrate part 220 is bent toward the rear surface 212 of the substrate part 210 with respect to the front surface 211 of the substrate part 210 and the substrate part 230 is bent toward the rear surface 212 of the substrate part 210 with respect to the front surface 211 of the substrate part 210. The patch antennas 300 of the antenna group 310, the patch antennas 300 of the antenna group 320, and the patch antennas 300 of the antenna group 330 have different radiation directions from each other. The heat-radiating member 500 is arranged so as to contact the integrated circuit 110 on the rear surface 212 side of the substrate part 210.

The antenna module 100 includes the substrate parts 210, 220, and 230. The substrate parts 220 and 230 are bent toward the rear surface 212 with respect to the front surface 211, and therefore radio waves can be radiated in different directions from that of the antenna group 310 provided on the substrate part 210 as a result of the antenna groups 320 and 330, which are each composed of a plurality of patch antennas 300, being provided on the substrate parts 220 and 230. That is, the antenna module 100 can radiate radio waves in a plurality of directions.

Furthermore, the antenna module 100 is controlled by the integrated circuit 110, and therefore an increase in size arising from a plurality of integrated circuits 110 being provided can be suppressed. The dielectric substrate 200 is attached to the heat-radiating member 500 by the connection members 600, and therefore the bent state of the dielectric substrate 200 can be prevented from changing.

Furthermore, since signals are collectively inputted via the connector 400 in the case where the radio waves are radiated in a plurality of directions, wiring lines connected to the antenna module 100 can be gathered together. Since the wiring lines can be gathered together, an increase in size arising from the wiring lines of the antenna module 100 can be suppressed even in the case where radio waves are radiated in a plurality of directions.

In addition, in the antenna modules 100, 100A, 100B, 100C, and 100D, the front surfaces 211, 211A, 211B, 211C, and 211D of the substrate parts 210, 210A, 210B, 210C, and 210D have a polygonal shape. The substrate parts 220, 220A, 220B, 220C, and 220D are formed so as to extend from edges 2132, 2132A, 2132B, 2132C, and 2132D of the polygonal shapes of the front surfaces 211, 211A, 211B, 211C, and 211D of the substrate parts 210, 210A, 210B, 210C, and 210D. The substrate parts 230, 230A, 230B, 230C, and 230D are formed so as to extend from other edges 2133, 2133A, 2133B, 2133C, and 2133D of the polygonal shapes of the front surfaces 211, 211A, 211B, 211C, and 211D of the substrate parts 210, 210A, 210B, 210C, and 210D.

In the antenna modules 100, 100A, 100B, 100C, and 100D, the substrate parts 220, 220A, 220B, 220C, and 220D can be bent along the edges 2132, 2132A, 2132B, 2132C, and 2132D of the polygonal shapes. The bending processing can be easily performed since a straight line bending method is used.

In the antenna modules 100H, 100I, and 100J, the front surfaces 211H, 211I, and 211J of the substrate parts 210H, 210I, and 210J have a circular shape. The substrate parts 220H, 220I, and 220J are formed so as to extend from parts 2132H, 2132I, and 2132J of the outer circumferences of the circular shapes of the front surfaces 211H, 211I, and 211J of the substrate parts 210H, 210I, and 210J. The substrate parts 230H, 230I, and 230J are formed so as to extend from other parts 2133H, 2133I, 2133J of the outer circumferences of the circular shapes of the front surfaces 211H, 211I, and 211J of the substrate parts 210H, 210I, and 210J.

The antenna modules 100H, 100I, and 100J can radiate radio waves along the curved surfaces formed by the substrate parts 220H, 220I, and 220J and can widen the range over which radio waves can be radiated compared with the case of planar substrate parts.

Furthermore, in the antenna module 100K, the substrate parts 210K, 220K, and 230K are formed so as to curve in an integrated manner. As a result of the substrate parts 210K, 220K, and 230K of the antenna module 100K being formed so as to be integrated with each other, radio waves can be radiated along a curved surface and the range over which radio waves can be radiated can be widened compared with the case of the planar substrate parts.

Furthermore, in the antenna modules 100, 100B, 100D, 100E, 100H, 100I, and 100J, the substrate parts 220, 220B, 220D, 220E, 220H, 220I, and 220J and the substrate parts 230, 230B, 230D, 230E, 230H, 230I, 230J are formed so as to be symmetrical with each other in a plan view about the substrate parts 210, 210B, 210D, 210E, 210H, 210I, and 210J.

Due to this configuration, the antenna modules 100, 100B, 100D, 100E, 100H, 100I, and 100J can radiate radio waves in symmetrical directions.

Figure 22:
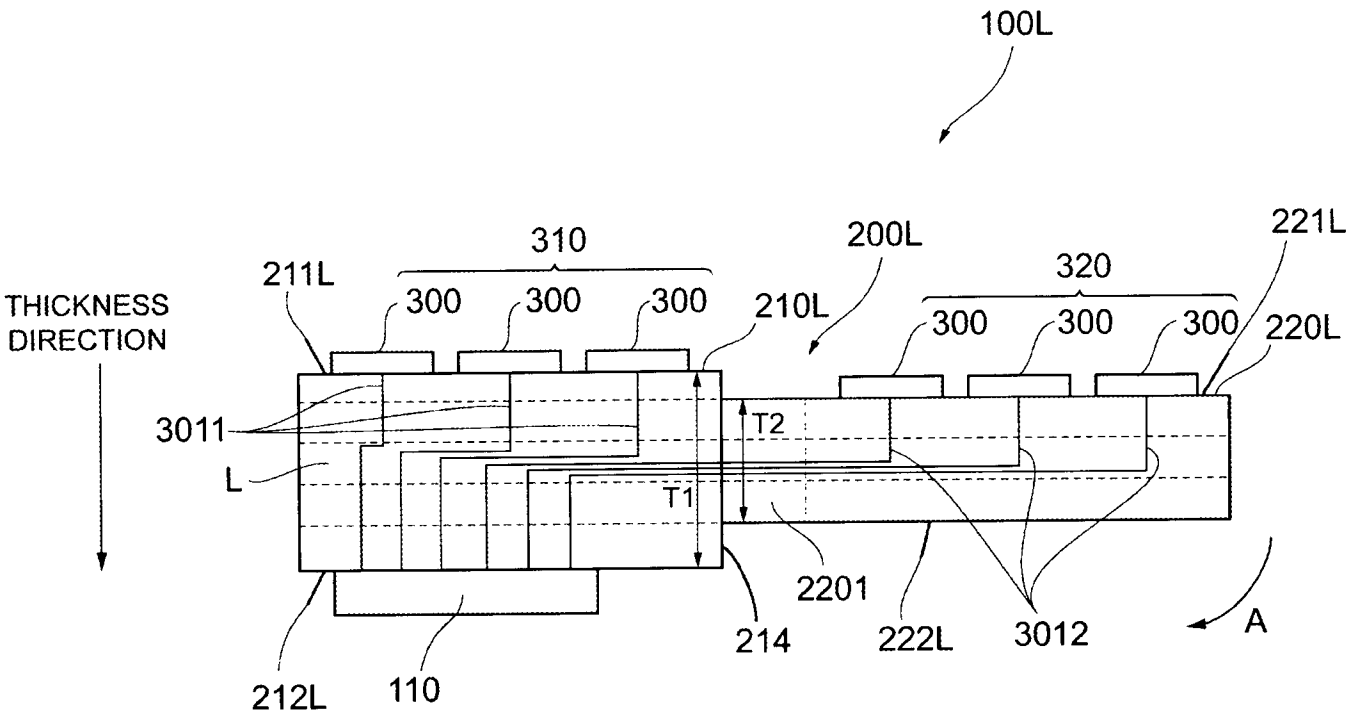
FIG. 22 is a front view of an antenna module according to an eighth embodiment.

An antenna module 100L according to an eighth embodiment will be described while referring to FIG. 22. FIG. 22 is a front view seen from a direction along a main surface of the antenna module 100L. FIG. 22 illustrates a state that exists prior to the bending of the antenna module 100L.

The antenna module 100L includes the integrated circuit 110, a dielectric substrate 200L, and a plurality of patch antennas 300. In addition, although not illustrated, the antenna module 100L includes a connector, a heat-radiating member, and connection members. The connector, heat-radiating member, and connection members are not illustrated in the eighth to twelfth embodiments.

An antenna group 310 composed of a plurality of patch antennas 300 is arranged on a front surface 211L of a substrate part 210L. The substrate part 210L has a side surface 214 that extends in the thickness direction from the front surface 211L of the substrate part 210L to a rear surface 212L of the substrate part 210L. The side surface 214 is for example a substantially rectangular surface.

The integrated circuit 110 is arranged on the rear surface 212L of the substrate part 210L. The integrated circuit 110 and patch antennas 300, which are provided on the substrate part 210L, are connected to each other by wiring lines 3011 that extend through the inside of the substrate part 210L.

A substrate part 220L has a front surface 221L on which an antenna group 320 composed of a plurality of patch antennas 300 is arranged on the front surface 211L side of the substrate part 210L. The substrate part 220L has a connection part 2201 that is connected to the substrate part 210L so as to extend from part of the side surface 214. In FIG. 22, the connection part 2201 is located in a region defined by a dotted line that extends in the thickness direction inside the substrate part 220L. The integrated circuit 110 and patch antennas 300, which are provided on the substrate part 220L, are connected to each other by wiring lines 3012 that extend through the inside of the substrate part 220L. An antenna is not arranged at the connection part 2201 in a plan view. In the antenna module 100L after bending has been performed, the connection part 2201 is bent (not illustrated).

The substrate part 210L and the substrate part 220L are multilayer substrates and each include a plurality of conductor layers. The substrate part 210L is also connected to the patch antennas 300 on the substrate part 220L not only the patch antennas 300 on the substrate part 210L. Therefore, in order to appropriately provide the wiring lines, it is necessary to make the number of conductor layers in the substrate part 210L greater than in the substrate part 220L. Here, as an example, a case is illustrated in which the substrate part 210L has five layers and the substrate part 220L has three layers.

The substrate part 210L and the substrate part 220L include a wiring layer L, which is a continuous conductor layer. The wiring lines 3011 and the wiring lines 3012 are connected to the patch antennas 300 through vias that extend in the thickness direction and wiring patterns formed inside the wiring layer L.

In FIG. 22, the wiring lines 3011 and 3012 are connected to the patch antennas 300 using vias in two layers from the integrated circuit 110 up to the wiring layer L.

In FIG. 22, the positions of the wiring lines 3011 and the wiring lines 3012 in the thickness direction are illustrated as being separated from each other, but in reality the wiring lines 3011 and the wiring lines 3012 would be formed in the same plane in the wiring layer L.

Since fewer layers are needed in the substrate part 220L than in the substrate part 210L, a thickness T2 of the connection part 2201, which is part of the substrate part 220L, in the thickness direction is smaller than a thickness T1 of the substrate part 210L in the thickness direction.

Antenna coverage can be secured in the antenna module 100L as well by bending the substrate part 220L as in the antenna module 100 according to the first embodiment. A method in which the dielectric substrate 200L bent by applying heat to the dielectric substrate 200L may be used as the method of bending the substrate part 220L. When the thickness of the connection part 2201 is small, it is easy to bend the substrate part 220L toward the rear surface 212L of the substrate part 210L as indicated by the arrow A.

When manufacturing the antenna module 100L, bending variations occur between the individual antenna modules 100L after bending the substrate parts 220L. The bending variations are adjusted by fixing the antenna module 100L to a casing. The bending variations are easily fixed as a result that it is easy to bend the substrate part 220L.

Figure 23:
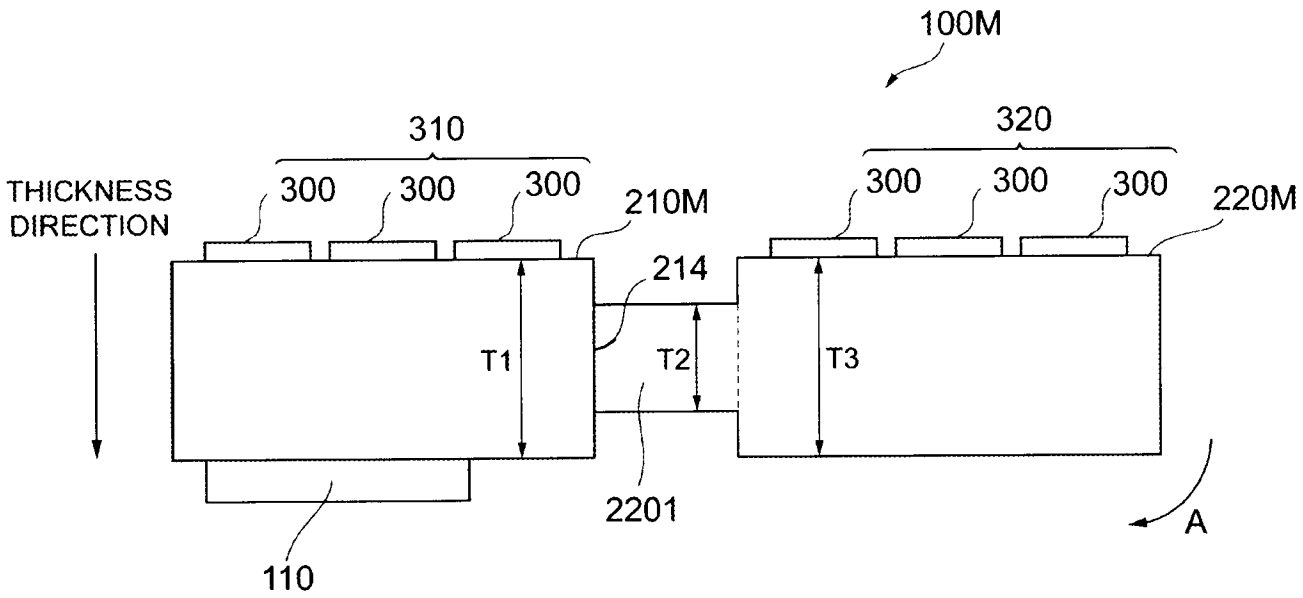
FIG. 23 is a front view of an antenna module according to a modification of the eighth embodiment.

An antenna module 100M according to a modification of this embodiment will be described while referring to FIG. 23. In the antenna module 100M, a thickness T2 of the connection part 2201 is smaller than a thickness T1 of a substrate part 210M. The thickness T2 is smaller than a thickness T3 of a part of a substrate part 220M other than the connection part 2201. Consequently, it is easy to bend the connection part 2201. Therefore, it is easy to correct the bending variations in the antenna module 100M as well.

Figure 24:
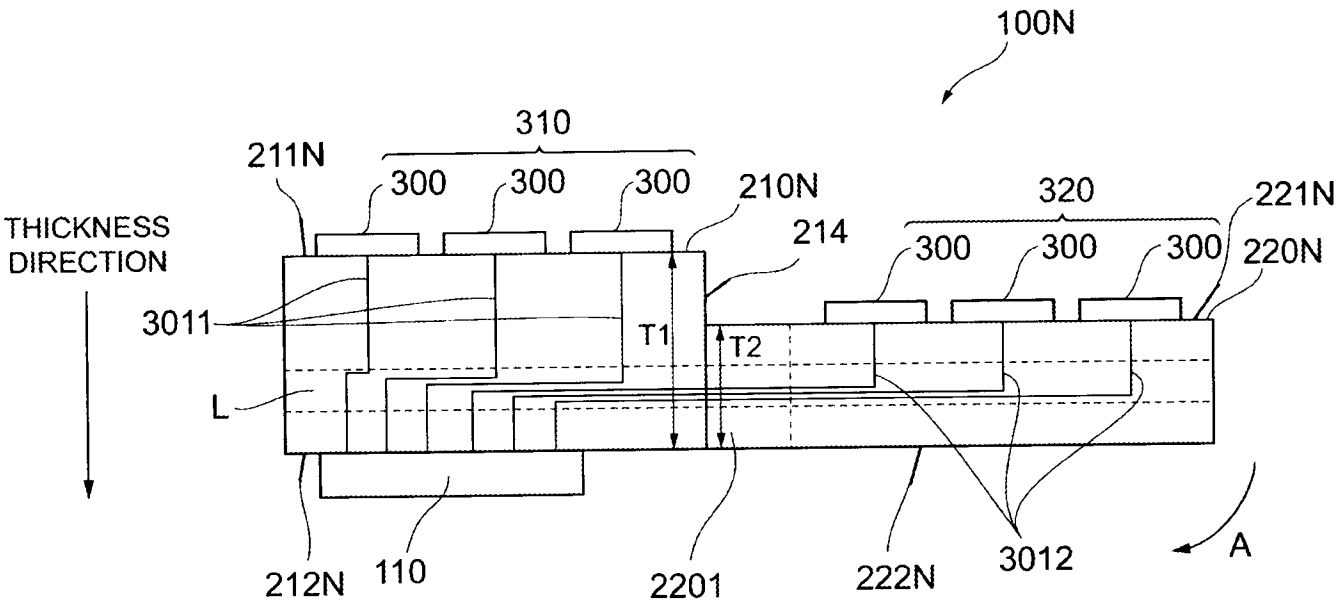
FIG. 24 is a front view of an antenna module according to a ninth embodiment.

An antenna module 100N according to a ninth embodiment will be described while referring to FIG. 24. As illustrated in FIG. 24, the antenna module 100N differs from the antenna module 100L in that a rear surface 222N of a substrate part 220N is continuous with a rear surface 212N of a substrate part 210N. In FIG. 24 as well, the wiring lines 3011 and 3012 are formed in the same plane in the wiring layer L.

Figure 25:
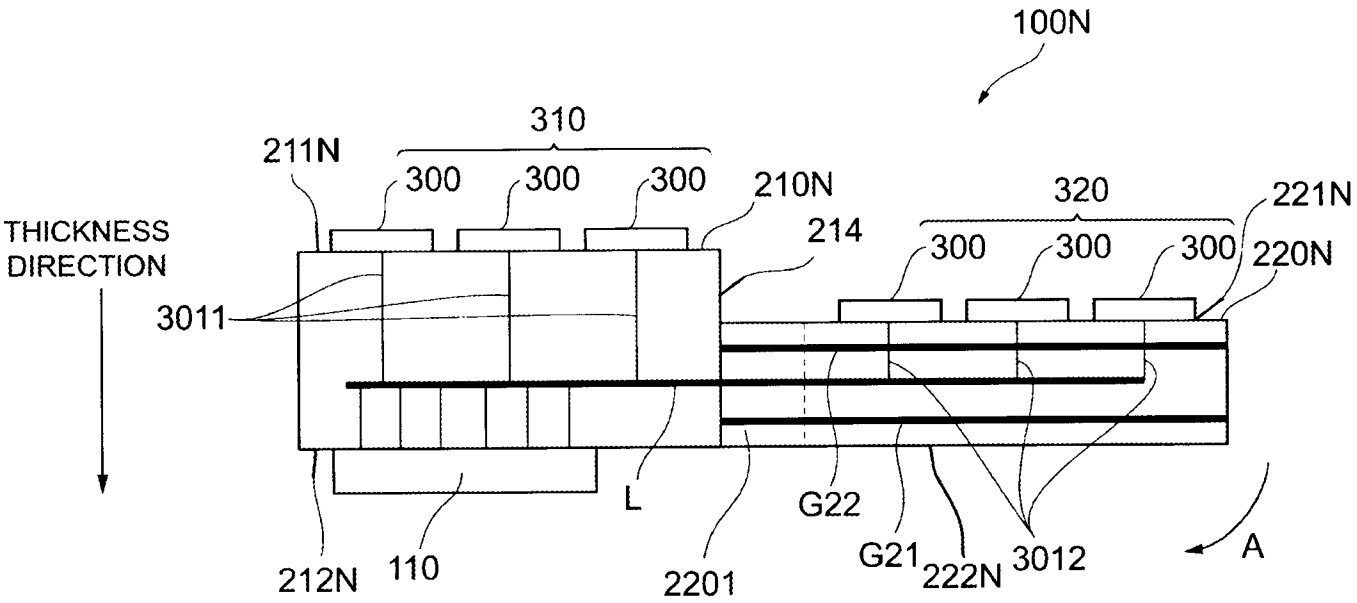
FIG. 25 is a schematic diagram of conductor layers in the antenna module according to the ninth embodiment.

FIG. 25 schematically illustrates parts of the layers of the substrate part 210N and the substrate part 220N. The substrate part 210N includes ground layers G11 and G12, which are conductor layers in which ground patterns are formed. The substrate part 220N also similarly includes ground layers G21 and G22. The wiring layer L in the substrate part 210N is at a position interposed between the ground layers G11 and G12. The wiring layer L in the substrate part 210N is at a position interposed between the ground layers G21 and G22.

In this case, the wiring lines 3011 and 3012 are connected to the patch antennas 300 using vias in one layer from the integrated circuit 110 up to the wiring layer L. Therefore, the loss from the vias can be reduced compared with the antenna module 100L. By reducing the loss from the vias while reducing the thickness of the substrate part 220N, the efficiency of the antenna module 100N can be improved while ensuring that it is easy to bend the substrate part 220N.

An antenna module 100O according to a tenth embodiment will be described while referring to FIGS. 26 and 27. The antenna module 100O differs from the antenna module 100L in that a thickness T1 is smaller than a thickness T2.

Although the thickness T2 is different, the number of layers constituting a substrate part 220O is three. In the substrate part 220O, the interval between the wiring layer L and the ground layers G21 and G22 is larger than in the antenna module 100L.

Figure 27:
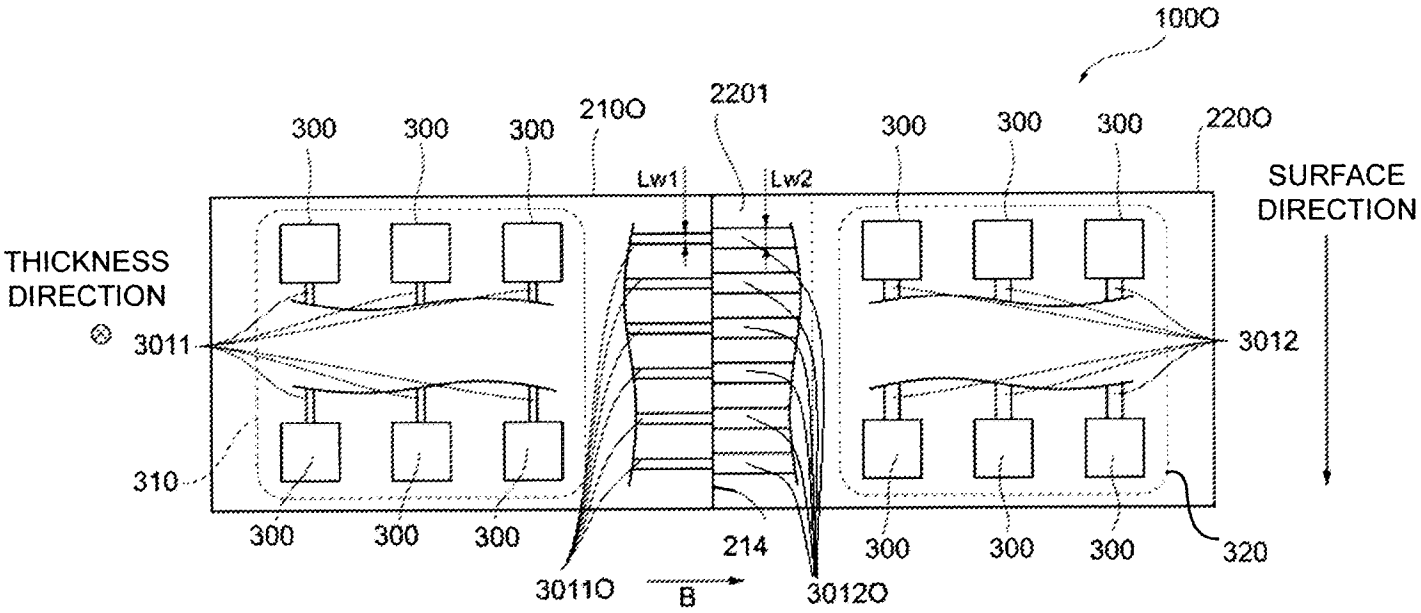
FIG. 27 is a plan view of the antenna module according to the tenth embodiment.

FIG. 27 is a plan view of a substrate part 210O and the substrate part 220O, and illustrates the patch antennas 300 on the front surface and wiring lines 3011, wiring lines 3011O, wiring lines 3012, and wiring lines 3012O formed in the wiring layer L inside from the front surface. The wiring lines 3012O are wiring lines provided in the connection part 2201. As illustrated in FIG. 27, a width Lw2 of the wiring lines 3012O in the substrate part 220O is larger than a width Lw1 of the wiring lines 3011O in the substrate part 210O. The peripheral length of a cross section of the wiring lines 3011O in an extension direction B of the wiring lines 3011O in the substrate part 210O is smaller than the peripheral length of a cross section of the wiring lines 3012O in the extension direction B in the substrate part 220O. The peripheral length of a cross section of the wiring lines 3011O in the substrate part 210O refers to the peripheral length (the sum of the length of all the sides) of a wiring line 3011O in the substrate part 210O obtained when for example a wiring line 3011O in the substrate part 210O is cut along a surface direction and the resulting cross section of the wiring line 3011O in the substrate part 210O is viewed from a direction perpendicular to the surface direction in a plan view (i.e., direction B in FIG. 27). The peripheral length of a cross section of the wiring lines 3012O in the substrate part 220O in the extension direction B refers to the peripheral length (the sum of the length of all the sides) of a wiring line 3012O in the substrate part 220O obtained when for example a wiring line 3012O in the substrate part 220O is cut along the surface direction and the resulting cross section of the wiring line 3012O in the substrate part 220O is viewed from a direction perpendicular to the surface direction in a plan view (i.e., direction B in FIG. 27).

Wiring line loss of a radio-frequency signal is inversely proportional to the peripheral length of the cross section of a wiring line. Therefore, the loss in the wiring lines 3012O in the substrate part 220O can be reduced by increasing the peripheral length of the cross section of the wiring lines 3012O.

However, when the peripheral length of the cross section of the wiring lines 3012O in the substrate part 220O is increased, the impedance of the wiring lines 3012O becomes smaller. In this embodiment, the interval between the wiring layer L and the ground layers G21 and G22 is increased. When the interval is increased, the impedance of the wiring lines 3012O becomes larger. In other words, the decrease in the impedance of the wiring lines 3012O caused by increasing the peripheral length of the cross section of the wiring lines 3012O in the substrate part 220O can be compensated by an increase in the impedance of the wiring lines 3012O caused by the interval between the wiring layer L and the ground layers G21 and G22 being increased. In FIG. 27, the width of the wiring lines 3012 is larger than the width of the wiring lines 3011, but provided that the width Lw2 of the wiring lines 3012O in the substrate part 220O is larger than the width Lw1 of the wiring lines 3011O in the substrate part 210O, the width of the wiring lines 3012 may be approximately the same as the width of the wiring lines 3011.

Figure 26:
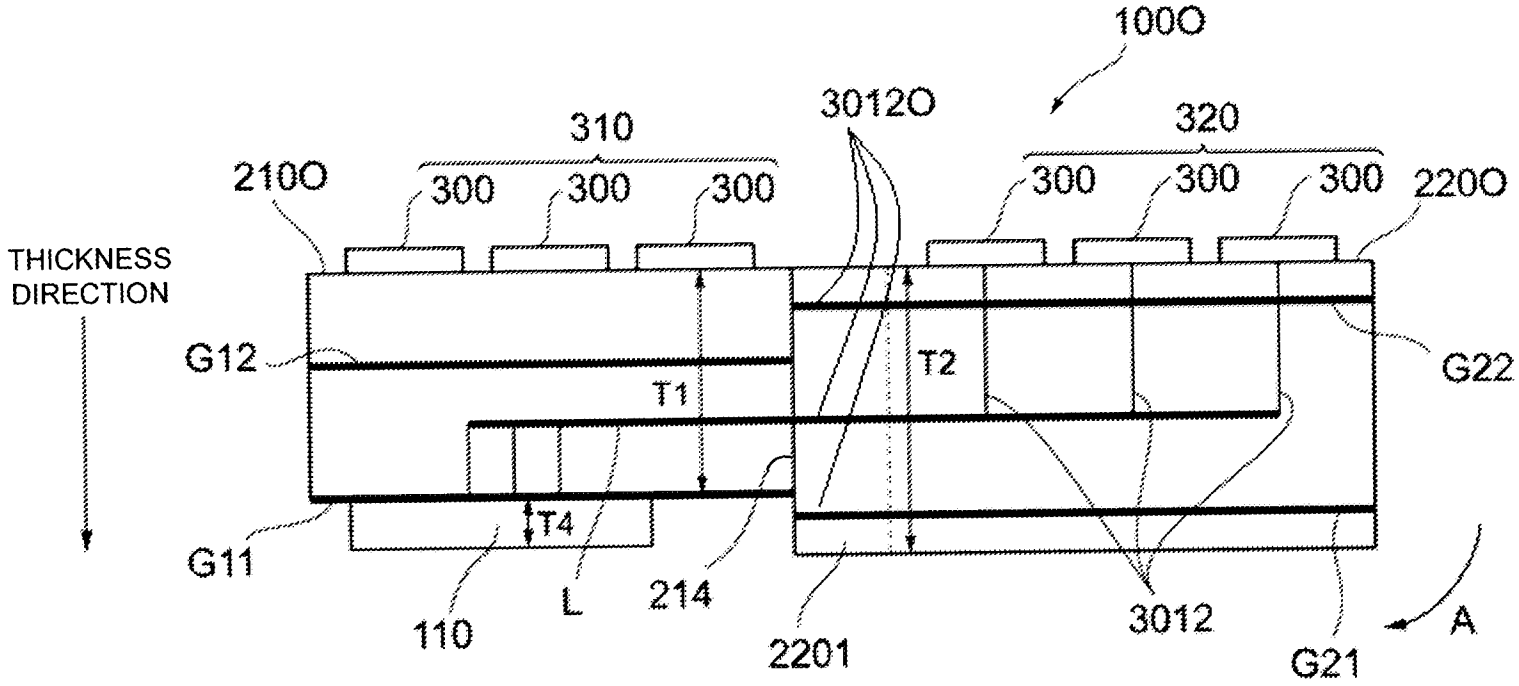
FIG. 26 is a front view of an antenna module according to a tenth embodiment.

In addition, as illustrated in FIG. 26, in the case where a thickness obtained by adding a thickness T4 of the integrated circuit 110 to the thickness T1 of the substrate part 210O is smaller than the thickness T2 of the substrate part 220O, this thickness does not lead to an increase in the thickness of the antenna module 100O when the substrate part 220O is bent in the direction of arrow A. However, the thickness of the antenna module 100O may be increased depending on the angle at which the substrate part 220O is bent.

Figure 28:
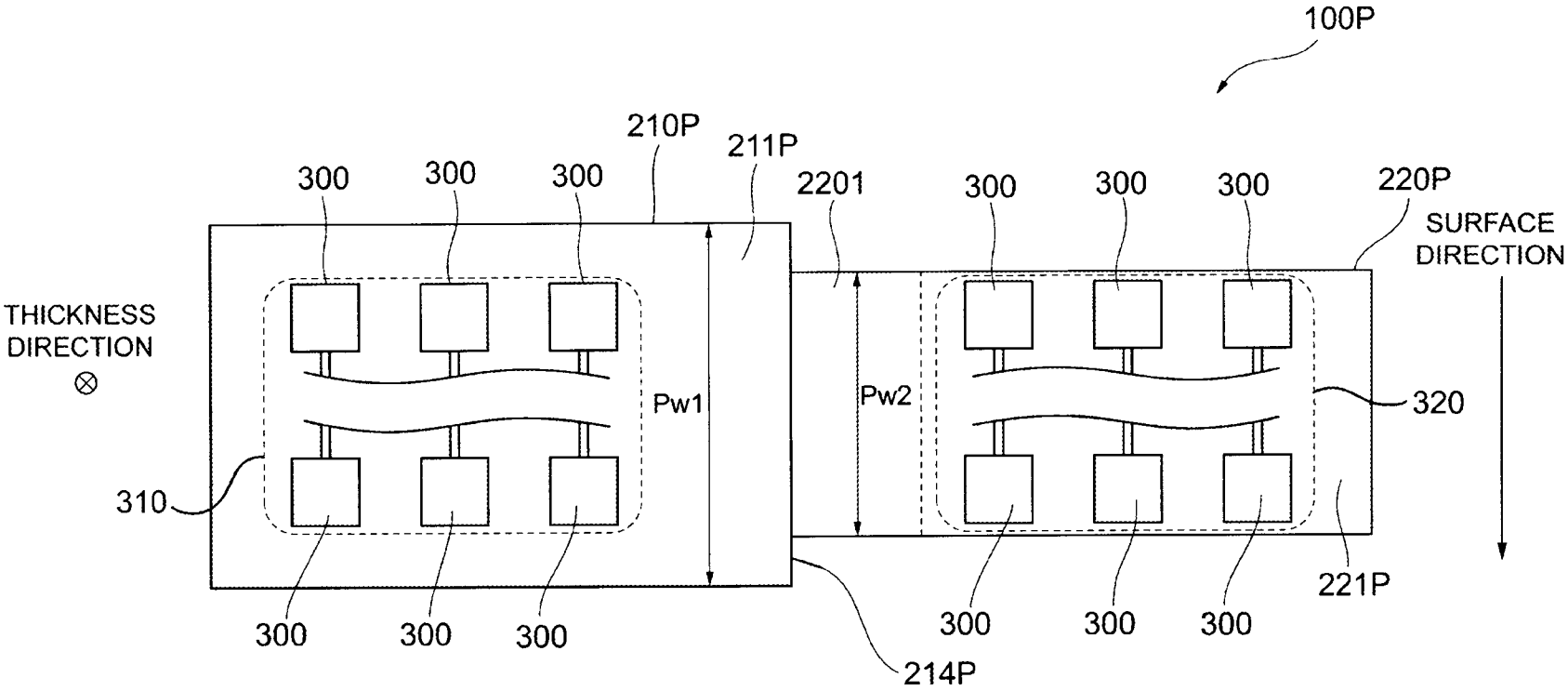
FIG. 28 is a plan view of an antenna module according to an eleventh embodiment.

An antenna module 100P according to an eleventh embodiment will be described while referring to FIGS. 28 to 30. FIG. 28 is a plan view of the antenna module 100P. In the antenna module 100P, a side surface 214P has a substantially rectangular shape having long edges that extend in a surface direction along a front surface 211P of a substrate part 210P. A width Pw1 of the substrate part 210P in the surface direction is larger than a width Pw2 of a substrate part 220P in the surface direction. In addition, when the widths Pw1 and Pw2 are changed, the number of patch antennas 300 arranged on a front surface 221P of the substrate part 220P is the same as when the widths are not changed.

Since the width Pw2 of the substrate part 220P is small, it is easier to bend the substrate part 220P than that in the antenna module 100. Therefore, it is easy to correct the bending variations in the antenna module 100P as well.

The obtainable number of antenna modules 100P can be increased by changing the width of the substrate part 220P. The obtainable number of antenna modules 100P will be described while referring to FIGS. 29 and 30. The antenna modules are formed by forming a plurality of antenna modules in a base material and then dividing the base material into individual antenna modules.

Figure 29:
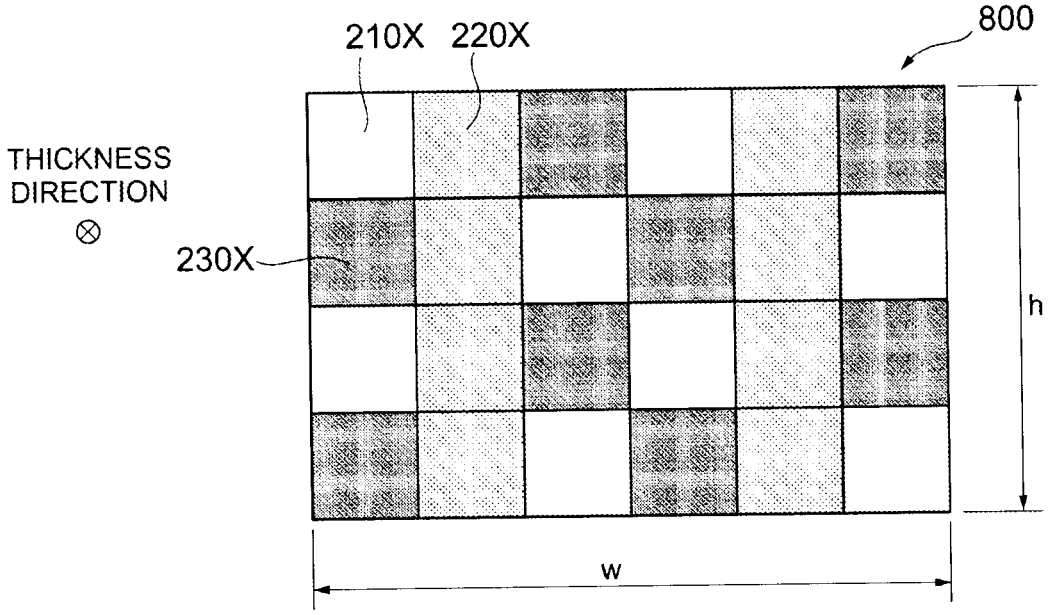
FIG. 29 is a plan view of a base material that is cut into antenna modules, and an antenna module.

FIG. 29 illustrates a plan view for a case where a plurality of antenna modules, which each include square substrate parts 210X, 220X, and 230X, are formed in a base material 800 having a width w and a height h. In this case, eight antenna modules can be obtained from the base material 800.

Figure 30:
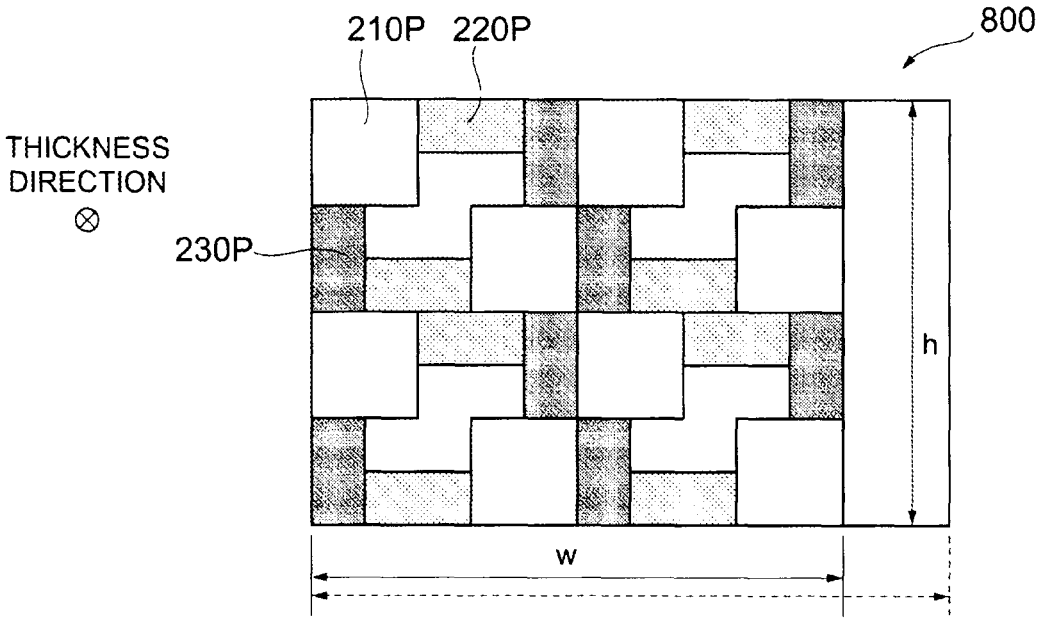
FIG. 30 is a plan view of a base material that is cut into antenna modules, and an antenna module according to the eleventh embodiment.

FIG. 30 illustrates a plan view for a case where a plurality of antenna modules, which each include a square substrate part 210P and a rectangular substrate part 220P and a rectangular substrate part 230P, are formed in a base material 800.

At this time, eight antenna modules can be obtained from the base material 800 as in the case in FIG. 29. Compared with the case in FIG. 29, the widths of the substrate part 220P, and the substrate part 230P are smaller, and therefore the width w of the base material needed in order to obtain the antenna modules is reduced. Therefore, the obtainable number of antenna modules can be increased.

Figure 31:
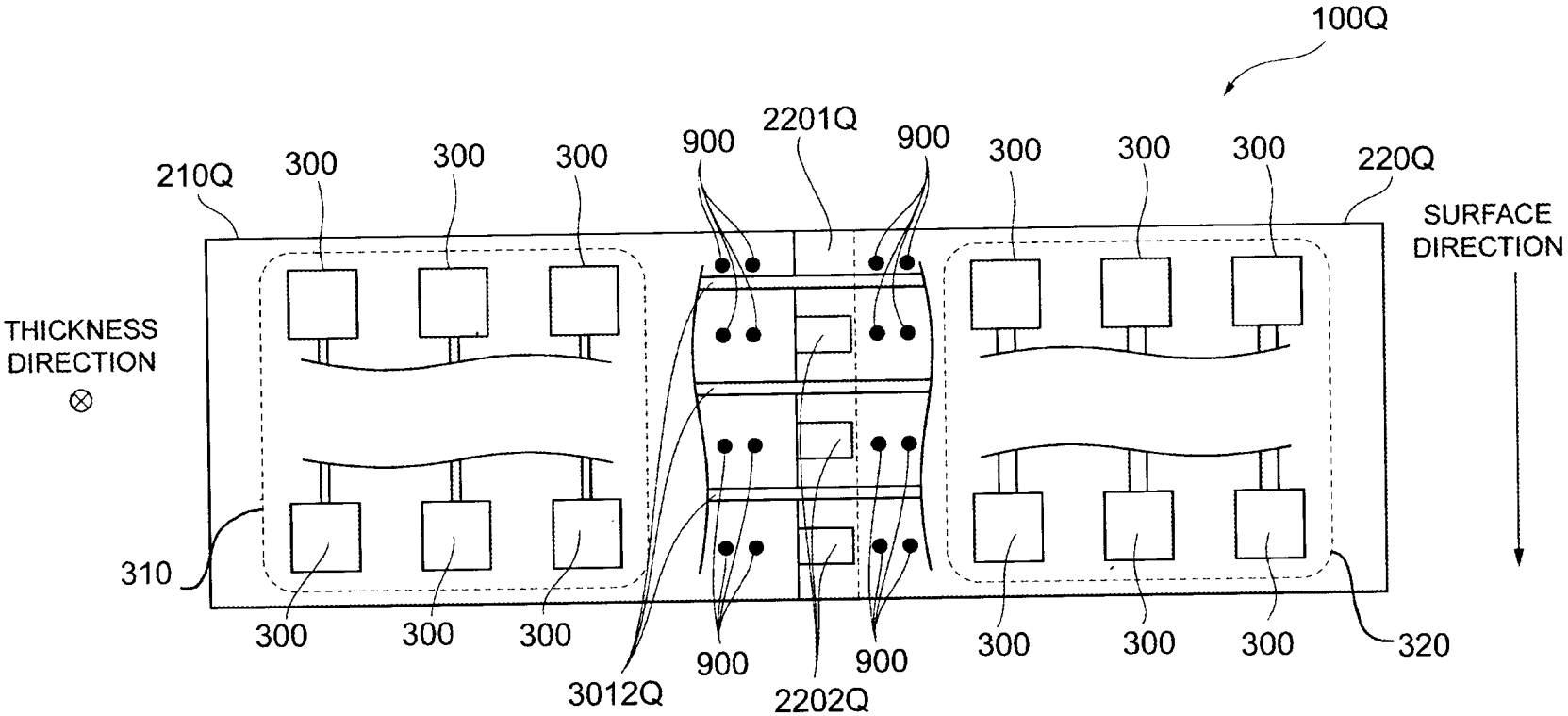
FIG. 31 is a plan view of an antenna module according to a twelfth embodiment.

An antenna module 100Q according to a twelfth embodiment will be described while referring to FIG. 31. FIG. 31 illustrates a plan view of the antenna module 100Q. The antenna module 100Q includes openings 2202Q in a connection part 2201Q.

The openings 2202Q are formed between wiring lines 3012Q that are connected from the integrated circuit (not illustrated) arranged on the rear surface of a substrate part 210Q to the patch antennas 300 via the inside of the substrate part 210Q and the connection part 2201Q. The openings 2202Q are provided so as to penetrate through a substrate part 220Q in the thickness direction. The openings 2202Q may instead have a prescribed depth and not penetrate completely through the substrate part 220Q.

A plurality of vias 900 are provided along the wiring lines 3012Q close to the connection part 2201Q between the substrate part 210Q and the substrate part 220Q. The vias 900 are provided in order to reduce the interference between the wiring lines 3012Q.

Due to the openings 2202Q being provided in the antenna module 100Q, it is easier to bend the connection part 2201Q compared with the antenna module 100. In addition, the interference between the wiring lines 3012Q, which extend through the connection part 2201Q, can be reduced by the openings 2202Q.

Eighth to twelfth embodiments have been described above. The antenna module 100L is an antenna module that includes: the dielectric substrate 200; the plurality of patch antennas 300; the integrated circuit 110 that controls transmission and reception of radio waves by the plurality of patch antennas 300; a connector that is used for inputting and outputting signals between the integrated circuit 110 and the outside; a heat-radiating member that is arranged so as to contact the integrated circuit 110 (heat-radiating member that allows heat generated by the integrated circuit 110 to be radiated); and connection members that connect the dielectric substrate 200 and the heat-radiating member to each other. The dielectric substrate 200 includes: the substrate part 210L which has the front surface 211L on which the patch antennas 300 of the antenna group 310 are arranged out of the plurality of patch antennas 300 and the rear surface 212L on which the integrated circuit 110 and the connector are arranged; and the substrate part 220L that has the patch antennas 300 of the antenna group 320 arranged on the front surface 221L thereof, which is on the front surface 211L side of the substrate part 210L, and that includes the connection part 2201 that is connected to the substrate part 210L so as to extend from part of the side surface 214 of the substrate part 210L, the side surface 214 extending in a thickness direction from the front surface 211L of the substrate part 210L toward the rear surface 212L of the substrate part 210L. The front surface 221L of the substrate part 220L is bent toward the rear surface 212L of the substrate part 210L with respect to the front surface 211L of the substrate part 210L, the patch antennas 300 of the antenna group 310 and the patch antennas 300 of the antenna group 320 have different radiation directions from each other, the heat-radiating member is arranged so as to contact the integrated circuit 110 on the rear surface 212L side of the substrate part 210L, and the thickness T1 of the substrate part 210L is different from the thickness T2 of the connection part 2201.

With this configuration, the substrate part 220L can be given an appropriate thickness in accordance with the design requirements while enabling the patch antennas 300 to radiate radio waves in different radiation directions.

Furthermore, in the antenna modules 100L, 100M, and 100N, the thickness T2 is smaller than the thickness T1. Therefore, the substrate parts 220L, 220M, and 220N can be easily bent relative to the substrate parts 210L, 210M, and 210N.

Furthermore, in the antenna module 100M, the connection part 2201 has a rear surface 222M that is continuous with a rear surface 212M of the substrate part 210M. As a result, the loss arising from vias in the substrate part 210M can be reduced and the efficiency of the antenna module 100M is improved.

Furthermore, in the antenna module 100O, the thickness T2 is larger than the thickness T1 and the wiring lines 3012O, which are connected from the integrated circuit 110 to the patch antennas 300 of the antenna group 320 via the inside of the substrate part 220O and the inside or the front surface of the connection part 2201, have a cross-sectional peripheral length in the extension direction B in the substrate part 220O that is larger than the cross-sectional peripheral length of the wiring lines 3011O in the extension direction B in the substrate part 210O.

Thus, the loss in the wiring lines 3012 can be reduced and the efficiency of the antenna module 100O is improved.

In addition, in the antenna module 100P, the side surface 214P of the substrate part 210P has a substantially rectangular shape having long edges that extend in a surface direction along the front surface 211P of the substrate part 210P, and the width Pw1 of the substrate part 210P in the surface direction is larger than the width Pw2 of the substrate part 220 in the surface direction.

Thus, the number of antenna modules 100P that can be obtained during the manufacture can be increased while ensuring that it is easy to bend the antenna modules 100P.

In addition, in the antenna module 100Q, the openings 2202Q, which extend in the thickness direction of the connection part 2201Q, are formed in the connection part 2201Q. This configuration as well can make it easy to bend the substrate part 220Q.

Furthermore, in the antenna module 100Q, the openings 2202Q are formed between the wiring lines 3012Q, which are connected from the integrated circuit 110 to the patch antennas of the antenna group 320 via the inside of the substrate part 210Q and the connection part 2201Q. Thus, the interference between the wiring lines 3012Q can be reduced.

Figure 32:
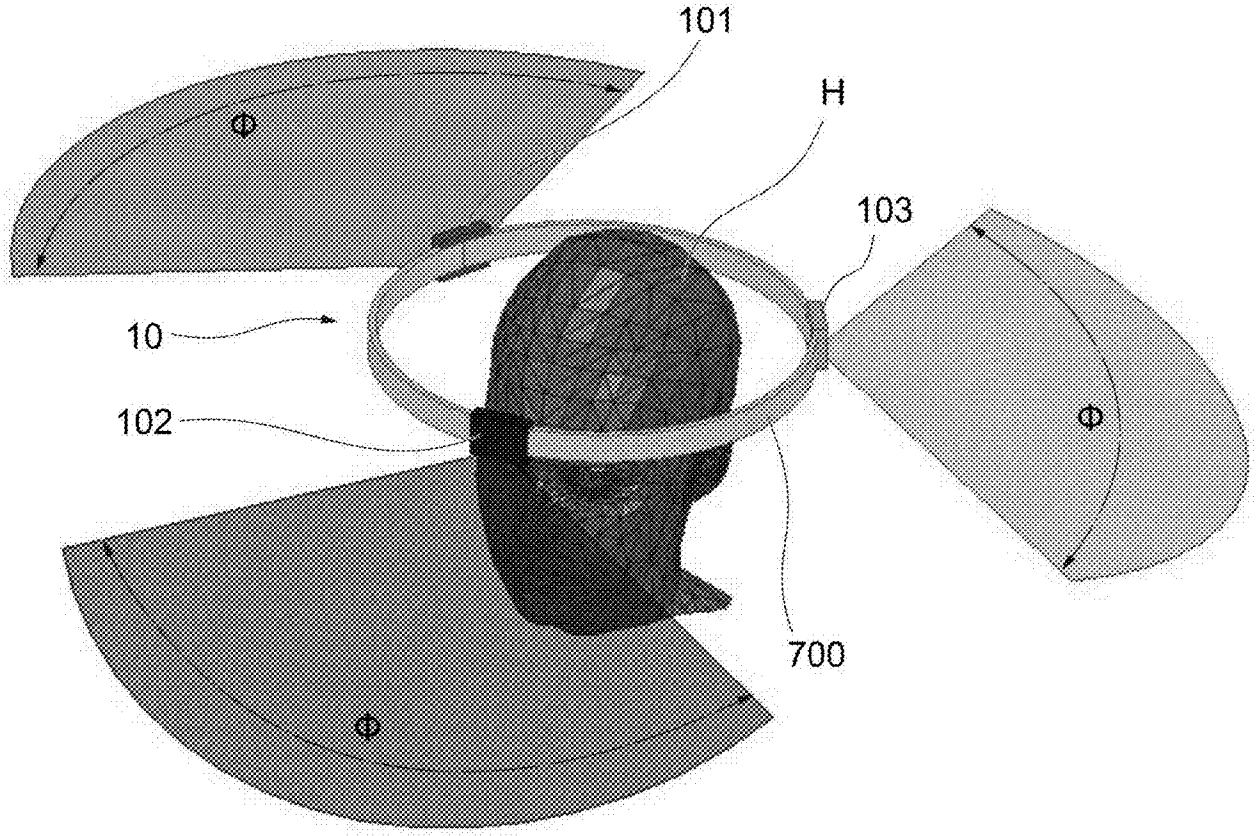
FIG. 32 is a schematic diagram of an antenna device according to a thirteenth embodiment.

An antenna device 10 according to a thirteenth embodiment will be described while referring to FIGS. 32 and 33. As illustrated in FIG. 32, the antenna device 10 includes antenna modules 101, 102, and 103 and a casing 700.

As illustrated in the schematic diagram in FIG. 32, the antenna device 10 is a device that is provided in an apparatus worn around the periphery of a head H of a person. The apparatus is a head-mounted display, for example. Illustration of the apparatus is omitted from FIG. 32 and only the antenna device 10 is illustrated.

Figure 33:
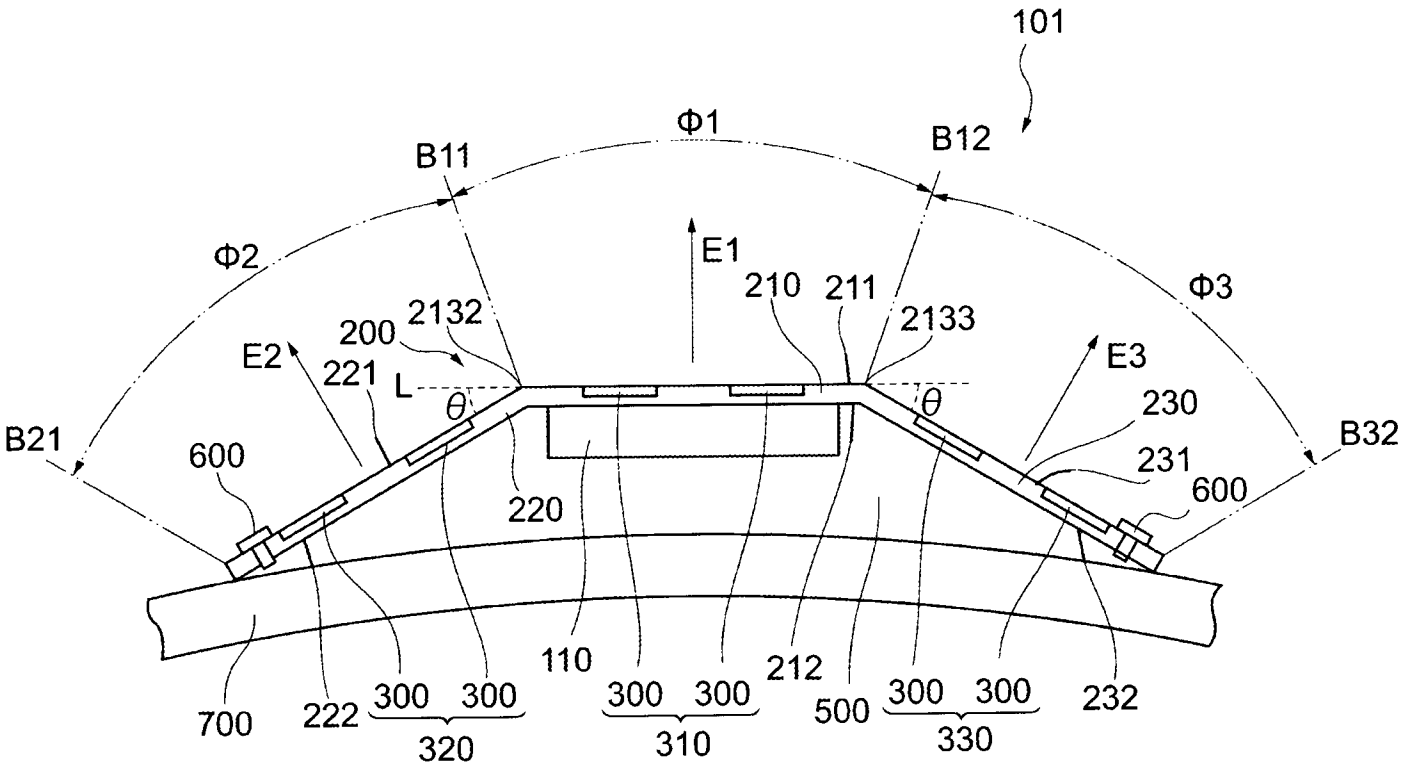
FIG. 33 is a sectional view of an antenna module used in the antenna device according to the thirteenth embodiment.

The antenna module 101 provided in the antenna device 10 is identical to the antenna module 100 according to the first embodiment as illustrated in FIG. 33, for example. This also applies to the antenna modules 102 and 103.

As illustrated in FIG. 32, the casing 700 is a substantially ring-shaped member. The antenna modules 101, 102, and 103 are arranged at regular intervals along the periphery of the casing 700. The front surfaces of the substrate parts of the antenna module 101, the front surfaces of the substrate parts of the antenna module 102, and the front surfaces of the substrate parts of the antenna module 103 are arranged so as to face in different directions from each other.

The angular range Φ over which radio waves can be transmitted and received by each antenna module is 120°. The antenna device 10 can transmit and receive radio waves over an angular range of 360° along the periphery of the head H by using the three antenna modules 101, 102, and 103.

The angular range over which radio waves can be transmitted and received by the antenna module 101 will be described while referring to FIG. 33. The antenna group 310 provided on the substrate part 210 can radiate radio waves over a range of an angle Φ1 from a straight line B11 to a straight line B12 with the substrate part 210 therebetween. The antenna group 320 can radiate radio waves over an angle Φ2 from a straight line B21 to the straight line B11 with the substrate part 220 therebetween. The antenna group 330 can radiate radio waves over an angle Φ3 from a straight line B32 to the straight line B12 with the substrate part 230 therebetween.

In FIG. 33, the angles Φ1, Φ2, and Φ3 are each 40°. In order for the antenna module 101 to radiate radio waves over a range of 120°, the bent angles θ at which the substrate part 220 and the substrate part 230 are bent with respect to the substrate part 210 are 40°.

In the case where the angular ranges over which radio waves can be radiated by the antenna groups 310, 320, and 330 are identical to each other, radio waves can be radiated without causing the angular ranges of the antenna groups 310 to overlap each other by setting those angular ranges and the bent angles θ of the substrate parts 220 and 230 to identical values.

The bent angle θ satisfies the following numerical expression, where Φs is the angular range over which it is desired to transmit and receive radio waves using the antenna device 10, N is the number of antenna modules provided in the antenna device 10, and M is the number of times the substrate parts of each antenna module are bent.

$$\Theta = \frac{\Phi_S}{N \times (M+1)}.$$

In the antenna device 10, Φs=360°, N=3, M=2, and θ=40°. On the basis of this expression, the number of antenna modules that are arranged and the number of times each antenna module is bent can be adjusted even in an antenna device that is different from the antenna device 10. Therefore, it is possible to design the antenna device 10 so as to be able to transmit and receive radio waves over a desired angular range.

Furthermore, the antenna device 10 may include the antenna module 101 and the antenna module 102, and the casing 700 on which the antenna module 101 and the antenna module 102 are arranged. The front surface of a substrate part of the antenna module 101 and the front surface of a substrate part of the antenna module 102 may be arranged so as to face in different directions.

Since the dielectric substrates of the antenna modules 101 and 102 are bent, each antenna module can radiate radio waves over a wide range. The antenna device 10 can radiate radio waves over an adequate range while reducing the number of antenna modules used by providing the thus-configured antenna modules 101 and 102 on the casing 700.

The purpose of the embodiments described above is to enable easy understanding of the present disclosure and the embodiments are not to be interpreted as limiting the present disclosure. The present disclosure can be modified or improved without departing from the gist of the disclosure and equivalents to the present disclosure are also included in the present disclosure. In other words, appropriate design changes made to the embodiments by one skilled in the art are included in the scope of the present disclosure so long as the changes have the characteristics of the present disclosure. For example, the elements included in the embodiments and the arrangements, materials, conditions, shapes, sizes and so forth of the elements are not limited to those exemplified in the embodiments and can be changed as appropriate. In addition, each embodiment is merely an illustrative example and it goes without saying that parts of the configurations illustrated in different embodiments can be substituted for each other or combined with each other and these new configurations are also included in the scope of the present disclosure so long as the configurations have the characteristics of the present disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An antenna module comprising:

a dielectric substrate;

a plurality of patch antennas arranged on a front surface of the dielectric substrate;

an integrated circuit for controlling transmission and reception of radio waves by the plurality of patch antennas;

a connector for inputting and outputting signals between the integrated circuit and an outside circuit;

a heat-radiating member arranged so as to contact the integrated circuit; and a connection member connecting the dielectric substrate and the heat-radiating member to each other;

wherein the dielectric substrate at least includes a first substrate part having a front surface on which patch antennas of a first group, out of the plurality of patch antennas, are arranged and a rear surface on which the integrated circuit and the connector are arranged, a second substrate part having a front surface on which patch antennas of a second group, out of the plurality of patch antennas, are arranged, and a third substrate part having a front surface on which patch antennas of a third group, out of the plurality of patch antennas, are arranged, the second substrate part is bent toward the rear surface of the first substrate part with respect to the front surface of the first substrate part, the third substrate part is bent toward the rear surface of the first substrate part with respect to the front surface of the first substrate part, the patch antennas of the first group, the patch antennas of the second group, and the patch antennas of the third group have different radiation directions from each other, and the heat-radiating member is arranged so as to contact the integrated circuit on the rear surface of the first substrate part.

2. The antenna module according to claim 1, wherein the front surface of the first substrate part has a substantially polygonal shape, the second substrate part extends from an edge of the substantially polygonal shape of the front surface of the first substrate part, and the third substrate part extends from another edge of the substantially polygonal shape of the front surface of the first substrate part.

3. The antenna module according to claim 1, wherein the front surface of the first substrate part has a substantially circular shape, the second substrate part extends from one part of an outer periphery of the substantially circular shape of the front surface of the first substrate part, and the third substrate part extends from another part of the outer periphery of the substantially circular shape of the front surface of the first substrate part.

4. The antenna module according to claim 1, wherein the first substrate part, the second substrate part, and the third substrate part are integrally curved.

5. The antenna module according to claim 1, wherein the second substrate part and the third substrate part are symmetrically arranged about the first substrate part in a plan view.

6. An antenna module comprising:

a dielectric substrate;

a plurality of patch antennas arranged on a front surface of the dielectric substrate;

an integrated circuit for controlling transmission and reception of radio waves by the plurality of patch antennas;

a connector for inputting and outputting signals between the integrated circuit and an outside circuit;

a heat-radiating member arranged so as to contact the integrated circuit in order to radiate heat generated by the integrated circuit; and a connection member connecting the dielectric substrate and the heat-radiating member to each other;

wherein the dielectric substrate at least includes a first substrate part having a front surface on which patch antennas of a first group, out of the plurality of patch antennas, are arranged, a rear surface on which the integrated circuit and the connector are arranged, and a side surface, and a second substrate part having a front surface on which patch antennas of a second group, out of the plurality of patch antennas, are arranged and having a connection part connected to the first substrate part and extending from a part of the side surface of the first substrate part, the side surface extending in a thickness direction from the front surface of the first substrate part to the rear surface of the first substrate part, the front surface of the second substrate part is bent toward the rear surface of the first substrate part with respect to the front surface of the first substrate part, the patch antennas of the first group and the patch antennas of the second group have different radiation directions from each other, the heat-radiating member is arranged so as to contact the integrated circuit on the rear surface of the first substrate part, and a first thickness of the first substrate part is different from a second thickness of the connection part.

7. The antenna module according to claim 6, wherein the second thickness is smaller than the first thickness.

8. The antenna module according to claim 7, wherein the connection part has a rear surface continuous with the rear surface of the first substrate part.

9. The antenna module according to claim 6, wherein the second thickness is larger than the first thickness, and wherein wiring lines are connected from the integrated circuit to patch antennas of the second group via the inside of the first substrate part and the connection part, and a cross-sectional peripheral length in an extension direction of the wiring lines in the second substrate part is larger than a cross-sectional peripheral length of the wiring lines in the extension direction of the wiring lines in the first substrate part.

10. The antenna module according to claim 6, wherein the side surface of the first substrate part has a substantially rectangular shape having long edges extending in a surface direction along the front surface of the first substrate part, and a width of the first substrate part in the surface direction is larger than a width of the second substrate part in the surface direction.

11. The antenna module according to claim 6, wherein the connection part has an opening extending in a thickness direction of the connection part.

12. The antenna module according to claim 11, wherein the opening is provided between wiring lines connected from the integrated circuit to the patch antennas of the second group via the inside of the first substrate part and the connection part.

13. An antenna device comprising:

a first antenna module and a second antenna module, each of which is the antenna module according to claim 1; and a casing in which the first antenna module and the second antenna module are arranged;

wherein the front surface of the first substrate part of the first antenna module is arranged so as to face in a different direction from the front surface of the first substrate part of the second antenna module.

14. The antenna module according to claim 2, wherein the first substrate part, the second substrate part, and the third substrate part are integrally curved.

15. The antenna module according to claim 3, wherein the first substrate part, the second substrate part, and the third substrate part are integrally curved.

16. The antenna module according to claim 2, wherein the second substrate part and the third substrate part are symmetrically arranged about the first substrate part in a plan view.

17. The antenna module according to claim 3, wherein the second substrate part and the third substrate part are symmetrically arranged about the first substrate part in a plan view.

18. The antenna module according to claim 4, wherein the second substrate part and the third substrate part are symmetrically arranged about the first substrate part in a plan view.

19. The antenna module according to claim 7, wherein the connection part has an opening extending in a thickness direction of the connection part.

20. The antenna module according to claim 8, wherein the connection part has an opening extending in a thickness direction of the connection part.

* * * * *